US011330922B2

(12) United States Patent
Ludwig et al.

(10) Patent No.: US 11,330,922 B2
(45) Date of Patent: May 17, 2022

(54) PLATE COVERS

(71) Applicant: Whirley Industries, Inc., Warren, PA (US)

(72) Inventors: Benjamin L. Ludwig, Warren, PA (US); Peter Dorney, Warren, PA (US); Matthew Schlotzhauer, Warren, PA (US)

(73) Assignee: WHIRLEY INDUSTRIES INC., Warren, PA (US)

( * ) Notice: Subject to any disclaimer, the term of this patent is extended or adjusted under 35 U.S.C. 154(b) by 247 days.

(21) Appl. No.: 16/530,819

(22) Filed: Aug. 2, 2019

(65) Prior Publication Data

US 2020/0315382 A1 Oct. 8, 2020

Related U.S. Application Data

(63) Continuation-in-part of application No. 16/376,042, filed on Apr. 5, 2019, now abandoned.

(51) Int. Cl.
*A47G 19/26* (2006.01)
*B65D 43/02* (2006.01)

(52) U.S. Cl.
CPC ..... *A47G 19/26* (2013.01); *B65D 43/0204* (2013.01); *B65D 2543/00092* (2013.01); *B65D 2543/00296* (2013.01); *B65D 2543/00361* (2013.01); *B65D 2543/00407* (2013.01); *B65D 2543/00796* (2013.01)

(58) Field of Classification Search
CPC ..... A47G 19/26; B65D 43/0204; B65D 2543/00296; B65D 2543/00407; B65D 2543/00092; B65D 2543/00361; B65D 2543/00796; B65D 2543/00027
See application file for complete search history.

(56) References Cited

U.S. PATENT DOCUMENTS

| | | | |
|---|---|---|---|
| 1,973,449 | A | 9/1934 | Tighe, Jr. |
| D168,462 | S | 12/1952 | Krilow |
| D169,004 | S | 3/1953 | Krilow |
| 3,066,824 | A | 12/1962 | Bostrom |
| 3,375,954 | A | 4/1968 | Honkanen et al. |

(Continued)

OTHER PUBLICATIONS

Non-Final Office Action for U.S. Appl. No. 16/376,042, filed Apr. 5, 2019 and dated Dec. 4, 2020.

(Continued)

*Primary Examiner* — James N Smalley
(74) *Attorney, Agent, or Firm* — Buchanan Ingersoll & Rooney PC

(57) ABSTRACT

Disclosed is a plate cover system having a plurality of plate covers that can be configured to stack upon each other in a protracted configuration and/or or a collapsed configuration. In one embodiment, a first plate cover can be used to support a second plate cover by placing the second plate cover on top of the first plate cover, wherein a volume of space exists between the first plate cover and the second plate cover. The system can be transitioned between the protracted configuration and the collapsed configuration by slidably engaging channels disposed on sidewalls of the plate covers. Some embodiments include a rotation retention mechanism for securing the plate covers in place when in a protected or a collapsed configuration.

20 Claims, 36 Drawing Sheets

(56) References Cited

U.S. PATENT DOCUMENTS

| | | | | |
|---|---|---|---|---|
| 3,429,369 | A | 2/1969 | Segal | |
| 3,610,458 | A | 10/1971 | Nissley | |
| 3,794,090 | A | 2/1974 | Commisso | |
| 3,815,736 | A | 6/1974 | Sedlak | |
| RE28,720 | E | 2/1976 | Sedlak | |
| 4,530,344 | A | 7/1985 | Iyengar et al. | |
| 4,687,117 | A * | 8/1987 | Terauds | B65D 43/0212 220/781 |
| 4,741,452 | A | 5/1988 | Holzkopf | |
| 4,777,931 | A | 10/1988 | Ziegler et al. | |
| 4,863,058 | A | 9/1989 | Antoni et al. | |
| 5,287,959 | A | 2/1994 | Hansen et al. | |
| 5,356,026 | A | 10/1994 | Andress et al. | |
| 5,441,166 | A * | 8/1995 | Lucas, Jr. | B65D 43/0212 220/782 |
| 5,604,130 | A | 2/1997 | Warner et al. | |
| 5,763,831 | A | 6/1998 | Shotey et al. | |
| D588,866 | S | 3/2009 | Ho | |
| 8,186,533 | B1 | 5/2012 | Tseng | |
| D682,610 | S | 5/2013 | Carder et al. | |
| D749,354 | S | 2/2016 | Lentine | |
| D867,134 | S | 11/2019 | Savenok | |
| D877,559 | S | 3/2020 | Ludwig et al. | |
| D884,415 | S | 5/2020 | Ludwig et al. | |
| 2004/0188442 | A1 | 9/2004 | Ohyama | |

OTHER PUBLICATIONS

Non-Final Office Action dated Aug. 18, 2020 for U.S. Appl. No. 16/376,042.

PlateTopper® see http://platetopper.com/.

PlateTopper® see https://www.youtube.com/watch?v=cqvyTmOHS3w.

PlateToppers® https://www.amazon.com/PlateTopper-Red/dp/B006ZPTRPS/ref=cm_ cr_arp_d_product_top?ie=UTF8).

* cited by examiner

PLATE COVERS

CROSS-REFERENCE TO RELATED APPLICATIONS

This application is a continuation-in-part application to co-pending U.S. application Ser. No. 16/376,042, filed on Apr. 5, 2019, the entire contents of which is incorporated herein by reference.

FIELD OF THE INVENTION

Embodiments relate to a plate cover system having a plurality of plate covers that can be configured to stack upon each other in a protracted configuration and/or or a collapsed configuration.

BACKGROUND OF THE INVENTION

Conventional plate and other protection cover systems can be appreciated from U.S. Pat. Nos. 3,815,736, 3,375,954, 3,610,458, 3,794,090, 4,741,452, 5,604,130, and 5,763,831, 8,186,533.

Conventional plate and other protection cover systems are limited in that they fail to provide a means to selectively stack individual plate covers in a protracted configuration (for display of articles) and/or or a collapsed configuration (for stowing of the system).

SUMMARY OF THE INVENTION

Embodiments of the system include a plurality of plate covers that can be configured to stack upon each other in a protracted configuration and/or or a collapsed configuration. In one embodiment, a first plate cover can be used to support a second plate cover by placing the second plate cover on top of the first plate cover, wherein a volume of space exists between the first plate cover and the second plate cover. The system can be transitioned between the protracted configuration and the collapsed configuration by slidably engaging channels disposed on sidewalls of the plate covers.

In one embodiment, a plate cover can include a member having a closed top conjoined with sidewalls and an open bottom, forming a cavity, wherein the member has a first side and a second side, the first side being a portion of the member adjacent the cavity and the second side being a portion of the member subtending the cavity, wherein the member has an inner diameter and an outer diameter. At least one channel can be formed in the sidewalls, the at least one channel extending in a direction from the member top to the member bottom, the at least one channel having a mouth that is open and a butt that is closed. At least one retention mechanism can be formed in a surface of the second side. The at least one channel can be configured to reduce the inner diameter and the outer diameter of the member at the at least one channel. The at least one channel can be further configured to receive or be received by at least one channel of another member. The butt of the at least one channel is configured to engage the at least one retention mechanism.

In some embodiments, the at least one channel includes a plurality of channels.

In some embodiments, each channel of the plurality of channels is spaced equidistant from each other.

In some embodiments, the member has a base-engaging portion at or near the member bottom.

In some embodiments, the member has a pattern formed in or on the first side and/or second side at the member top.

In some embodiments, the member is made from plastic.

In some embodiments, member is transparent.

In one embodiment, a plate cover system can include a first plate cover, comprising: a member with a closed first plate cover top conjoined with first plate cover sidewalls and an open first plate cover bottom to form a first plate cover cavity, the first plate cover having a first plate cover first side and a first plate cover second side, the first plate cover first side being a portion of the first plate cover adjacent the first plate cover cavity and the first plate cover second side being a portion of the first plate cover subtending the first plate cover cavity, wherein the first plate cover has an inner diameter $ID_1$ and an outer diameter $OD_1$. A first plate cover channel can be formed in the first plate cover sidewalls, the first plate cover channel extending in a direction from the first plate cover top to the first plate cover bottom, the first plate cover channel having a first plate cover mouth that is open and a first plate cover butt that is closed, wherein the first plate cover channel reduces the $ID_1$ and the $OD_1$ to $ID_{1a}$ and $OD_{1a}$, respectively, at the first plate cover channel. A first plate cover retention mechanism can be formed in a surface of the first plate cover second side. The system can include a second plate cover, comprising: a member with a closed second plate cover top conjoined with second plate cover sidewalls and an open second plate cover bottom to form a second plate cover cavity, the second plate cover having a second plate cover first side and a second plate cover second side, the second plate cover first side being a portion of the second plate cover adjacent the second plate cover cavity and the second plate cover second side being a portion of the second plate cover subtending the second plate cover cavity, wherein the second plate cover has an inner diameter $ID_2$ and an outer diameter $OD_2$. A second plate cover channel can be formed in the second plate cover sidewalls, the second plate cover channel extending in a direction from the second plate cover top to the second plate cover bottom, the second plate cover channel having a second plate cover mouth that is open and a second plate cover butt that is closed, wherein the second plate cover channel reduces the $ID_2$ and the $OD_2$ to $ID_{2a}$ and $OD_{2a}$, respectively, at the second plate cover channel. A second plate cover retention mechanism can be formed in a surface of the second plate cover second side. When the second plate cover is placed on top of the first plate cover: the first plate cover channel is configured to receive the second plate cover channel when the second plate cover channel and the first plate cover channel are aligned to generate a collapsed configuration between the first plate cover and the second plate cover; and the second plate cover butt is configured to rest upon the first plate cover top when the second plate cover channel and the first plate cover channel are misaligned to generate a protracted configuration between the first plate cover and the second plate cover. The second plate cover butt of the second plate cover channel is configured to engage the first plate cover retention mechanism when the plate cover system is in the protracted configuration.

In some embodiments, a volume of space is generated between the first plate cover second side and the second plate cover first side when in the protracted configuration that is larger than the volume of space generated between the first plate cover second side and the second plate cover first side when in the collapsed configuration.

In some embodiments, the volume of space in the protracted configuration is configured to display an article by the article being placed on the first plate cover second side.

In some embodiments, the second plate cover bottom is configured to allow rotation of the second plate cover relative to the first plate cover when the second plate cover channel and the first plate cover channel are misaligned and when the second plate channel is misaligned with the first plate cover retention mechanism.

In some embodiments, the first plate cover bottom has a base-engaging portion.

Some embodiments include a base.

Some embodiments include a base with a rim, and first plate cover bottom has a base-engaging portion configured to engage a rim of the base.

In some embodiments, $OD_1$ is less than $ID_2$, $OD_{1a}$ is less than $ID_{2a}$, and $ID_{2a}$ is less than $OD_1$.

Some embodiments include a third plate cover, comprising: a member with a closed third plate cover top conjoined with third plate cover sidewalls and an open third plate cover bottom to form a third plate cover cavity, the third plate cover having a third plate cover first side and a third plate cover second side, the third plate cover first side being a portion of the third plate cover adjacent the third plate cover cavity and the third plate cover second side being a portion of the third plate cover subtending the third plate cover cavity, wherein the third plate cover has an inner diameter $ID_3$ and an outer diameter $OD_3$. A third plate cover channel can be formed in the third plate cover sidewalls, the third plate cover channel extending in a direction from the third plate cover top to the third plate cover bottom, the third plate cover channel having a third plate cover mouth that is open and a third plate cover butt that is closed, wherein the third plate cover channel reduces the $ID_3$ and the $OD_3$ to $ID_{3a}$ and $OD_{3a}$, respectively, at the third plate cover channel. A third plate cover retention mechanism formed in a surface of the third plate cover second side.

In some embodiments, when the third plate cover is placed on top of the second plate cover: the second plate cover channel is configured to receive the third plate cover channel when the third plate cover channel and the second plate cover channel are aligned to generate a collapsed configuration between the second plate cover and the third plate cover; and the third plate cover butt is configured to rest upon the second plate cover top when the third plate cover channel and the second plate cover channel are misaligned to generate a protracted configuration between the second plate cover and the third plate cover. The third plate cover butt of the third plate cover channel is configured to engage the second plate cover retention mechanism when the plate cover system is in the protracted configuration.

In some embodiments, $OD_2$ is less than $ID_3$, $OD_{2a}$ is less than $ID_{3a}$, and $ID_{3a}$ is less than $OD_2$.

In some embodiments, the first plate cover bottom has a first plate cover base-engaging portion, the second plate cover bottom has a second plate cover base-engaging portion, and the third plate cover bottom has a third plate cover base-engaging portion.

In some embodiments, the second plate cover bottom is configured to allow rotation of the second plate cover relative to the first plate cover when the second plate cover channel and the first plate cover channel are misaligned and when the second plate channel is misaligned with the first plate cover retention mechanism. The third plate cover bottom is configured to allow rotation of the third plate cover relative to the second plate cover when the third plate cover channel and the second plate cover channel are misaligned and when the third plate channel is misaligned with the second plate cover retention mechanism.

BRIEF DESCRIPTION OF THE DRAWINGS

The above and other objects, aspects, features, advantages and possible applications of the present innovation will be more apparent from the following more particular description thereof, presented in conjunction with the following drawings. Like reference numbers used in the drawings may identify like components.

DETAILED DESCRIPTION OF THE INVENTION

Figure 1:
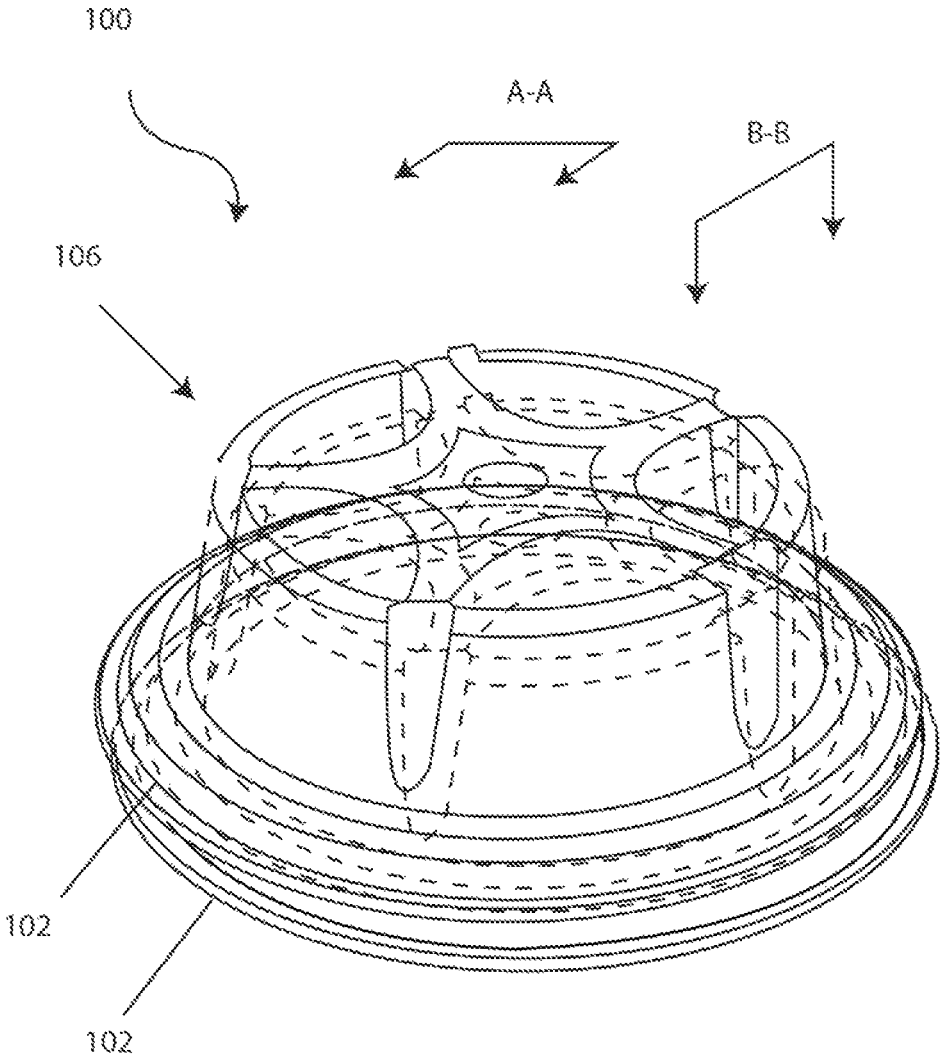
FIG. 1 shows an embodiment of the plate cover system with the system in an exemplary collapsed configuration.
Figure 2:
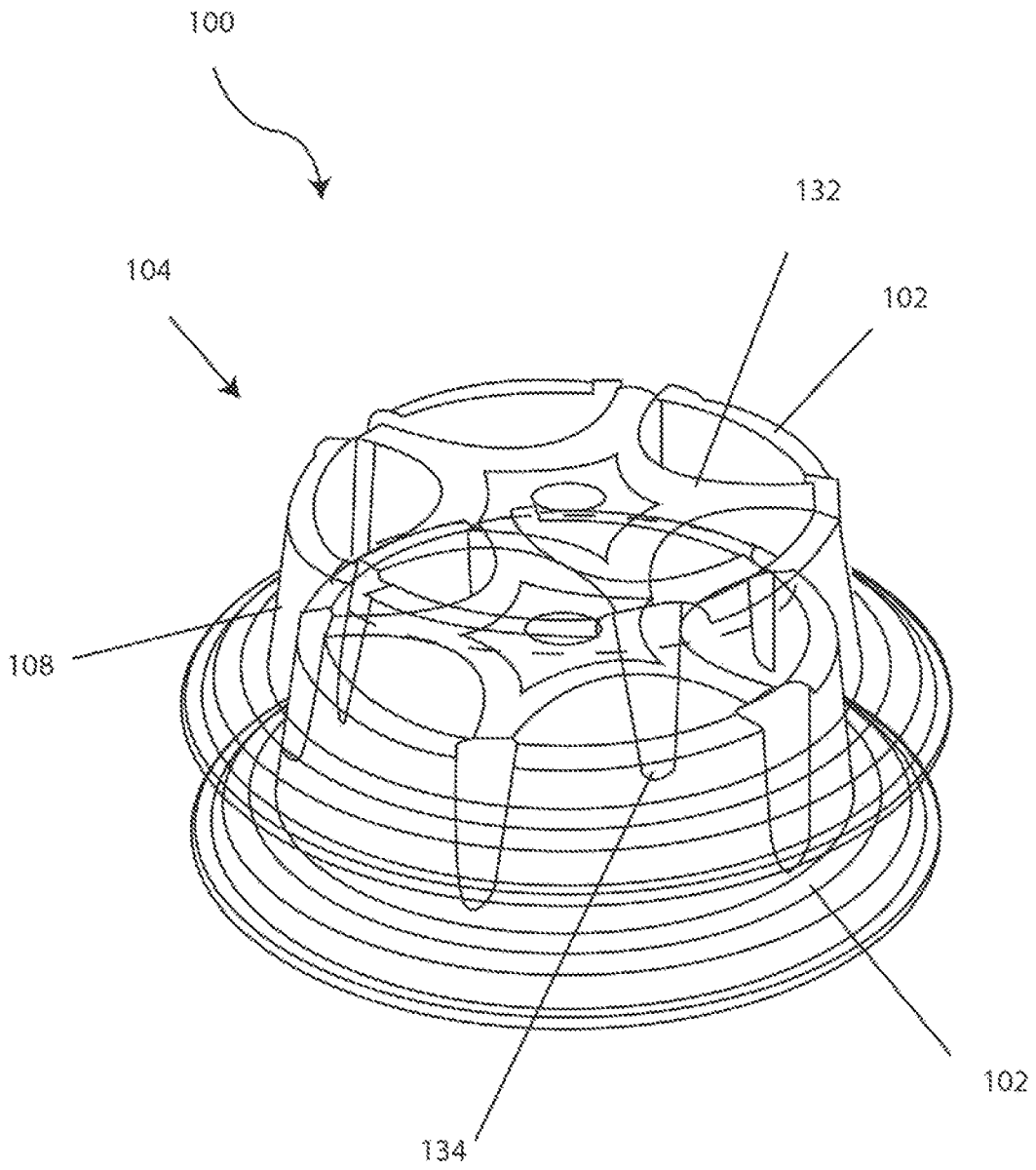
FIG. 2 shows an embodiment of the plate cover system with the system in an exemplary protracted configuration.
Figure 3:
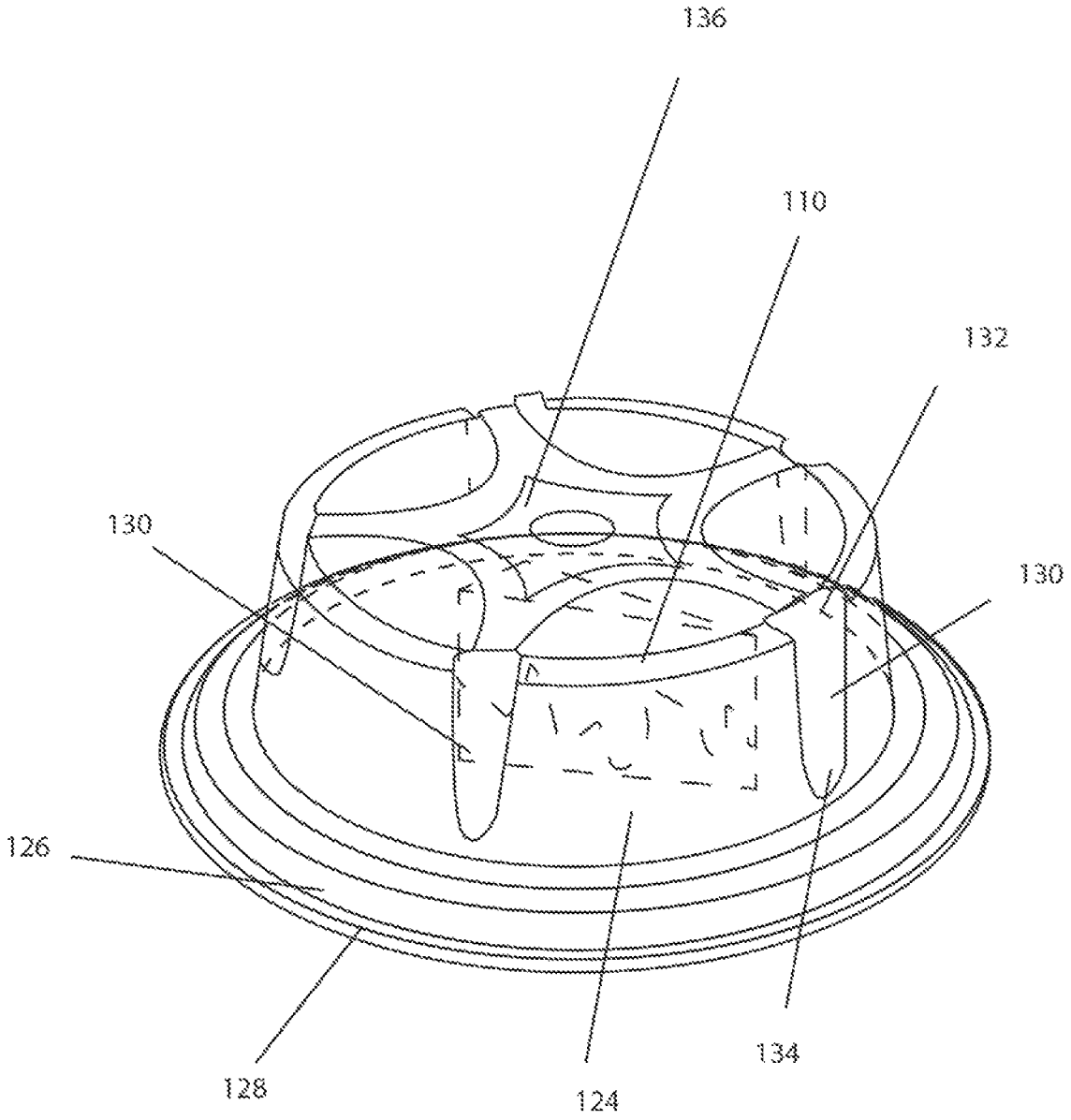
FIG. 3 shows an embodiment of the plate cover system with an article within a plate cover.
Figure 4:
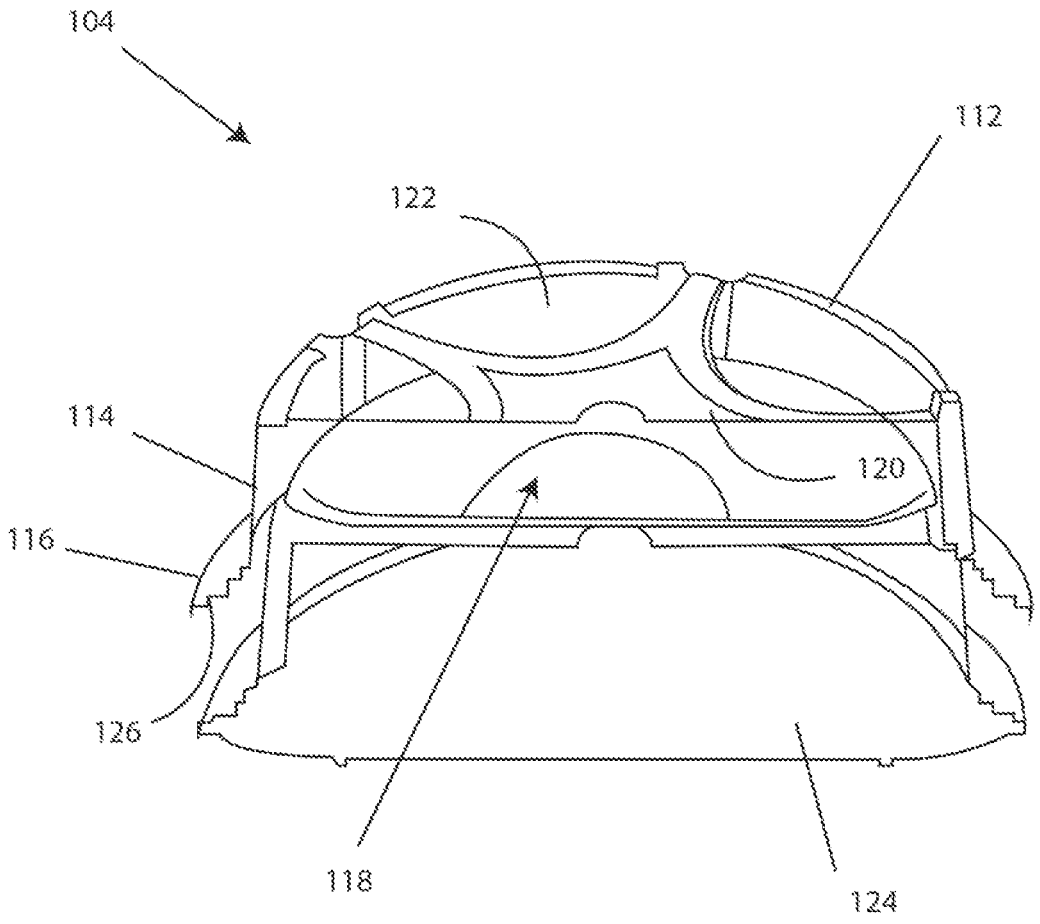
FIG. 4 shows a cross-sectional view along the B-B line (see FIG. 1) of an embodiment of the plate cover system.

The following description is of exemplary embodiments that are presently contemplated for carrying out the present invention. This description is not to be taken in a limiting sense, but is made merely for the purpose of describing the general principles and features of the present invention. The scope of the present invention is not limited by this description.

Referring to FIGS. 1-4, embodiments relate to a plate cover system 100 having a plurality of plate covers 102 that can be configured to stack upon each other in a protracted configuration 104 and/or or a collapsed configuration 106. For example, a first plate cover 102 can be used to support a second plate cover 102 by placing the second plate cover 102 on top of the first plate cover 102, wherein a volume of space 108 exists between the first plate cover 102 and the second plate cover 102. The volume of space 108 in the protracted configuration 104 is greater than the volume of space 108 in the collapsed configuration 106. It is contemplated for the plate cover system 100 to be used to cover, protect, and display an article 110 (e.g., a plate of food) placed within the volume of space 108 when the system 100 is in the protracted configuration 104. After the article 110 is removed from the volume of space 108, the system 100 can be transitioned to the collapsed configuration 106 to be stowed. As will be explained in detail, the transition between the protracted and collapsed configurations 104, 106 can be achieved by slidably engaging channels 130 disposed on a sidewall 114 portion of the plate covers 102.

While the system 100 is described and illustrated for use with a plate of food, other articles 110 can be used. In addition, while the protracted configuration 104 may be described and illustrated for using the system 100 to display and protect an article 110 and the collapsed configuration 106 may be described and illustrated for stowing the system 100, other uses for the two configurations 104, 106 can be used. For example, the system 100 can have a plurality of plate covers 102 in which some of the plate covers 102 are in the collapsed configuration 106 and some are in the protracted configuration 104. This can provide a means to display and protect the article(s) 110 within the plate covers 102 that are in the protracted configuration 104 while keeping a reserve of easily accessible plate covers 102 neatly stowed in the collapsed configuration 106. With the readily accessible plate covers 102 within the stack being in the collapsed configuration 106, a reserve of easily accessible plate covers 102 can be provided so that the system 100 itself occupies a minimum amount of space.

The system 100 can include a plurality of plate covers 102. For example, the system 100 can include a first plate cover 102, a second plate cover 102, a third plate cover 102, etc. Each plate cover 102 can be a member with a closed plate cover top 112 conjoined with plate cover sidewalls 114 and an open plate cover bottom 116 to form a plate cover cavity 118. Each plate cover 102 can have a plate cover first side 120 and a plate cover second side 122, the plate cover first side 120 being the portion of the plate cover 102 adjacent the plate cover cavity 118 (i.e., the "inside" of the plate cover 102) and the plate cover second side 122 being the portion of the plate cover 102 subtending the plate cover cavity 118 (i.e., the "outside" of the plate cover 102). The member can be a rigid or semi-rigid material, such as plastic, glass, metal (e.g., stainless steel, tin, aluminum, etc.), etc. The member can be transparent, translucent, or opaque.

For example, the first plate cover 102 can be a member with a closed first plate cover top 112 conjoined with first plate covers sidewalls 114 and an open first plate cover bottom 116 to form a first plate cover cavity 118. The first plate cover 102 can have a first plate cover first side 120 and a first plate cover second side 122, the first plate cover first side 120 being the portion of the first plate cover 102 adjacent the first plate cover cavity 118 and the first plate cover second side 122 being the portion of the first plate cover 102 subtending the first plate cover cavity 118. The second plate cover 102 can be a member with a closed second plate cover top 112 conjoined with second plate cover sidewalls 114 and an open second plate cover bottom 116 to form a second plate cover cavity 118. The second plate cover 102 can have a second plate cover first side 120 and a second plate cover second side 122, the second plate cover first side 120 being the portion of the second plate cover 102 adjacent the second plate cover cavity 118 and the second plate cover second side 122 being the portion of the second plate cover 102 subtending the second plate cover cavity 118. The third plate cover 102 can be a member with a closed third plate cover top 112 conjoined with third plate cover sidewalls 114 and an open third plate cover bottom 116 to form a third plate cover cavity 118. The third plate cover 102 can have a third plate cover first side 120 and a third plate cover second side 122, the third plate cover first side 120 being the portion of the third plate cover 102 adjacent the third plate cover cavity 118 and the third plate cover second side 122 being the portion of the third plate cover 102 subtending the third plate cover cavity 118. The fourth, fifth, sixth, etc. plate covers 102 can be similarly configured.

The plate covers 102 can have a shape. The shape can be circular, oval, triangular, square, rectangular, hexagonal, etc. For example, the plate cover 102 cross-section taken alone the A-A line (see FIG. 1) can be circular, oval, triangular, square, rectangular, hexagonal, etc. It is contemplated for at least two of the plurality of plate covers 102 to engage each other in a nested, or at least partially nested, manner. Thus, it is contemplated for the shape of one plate cover 102 to match, or at least compliment, that of the shape of another plate cover 102. As at least one plate cover 102 is contemplated to nest within another plate cover 102, the inner diameter ID (the distance between plate cover sidewalls 114 of a plate cover first side 120) of one plate cover 102 to be greater than the outer diameter OD (the distance between plate cover sidewalls 114 of a plate cover second side 122) of another plate cover 102. (See FIG. 6). For example, the first plate cover 102 can have an inner diameter ID of $ID_1$ and an outer diameter of $OD_1$, the second plate cover 102 can have an inner diameter ID of $ID_2$ and an outer diameter of $OD_2$, and the third plate cover 102 can have an inner diameter ID of $ID_3$ and an outer diameter of $OD_3$. $OD_1$ can be less than $ID_2$ so as to allow the second plate cover 102 to slide over the first plate cover 102 in a nested manner. $OD_2$ can be less than $ID_3$ so as to allow the third plate cover 102 to slide over the second plate cover 102 (which may include the first plate cover 102 if the second plate cover is slid over the first plate cover 102) in a nested manner.

The plate covers 102 can range in size. While the plate covers can have any size, it is contemplated for the outer diameter OD of a plate cover 102 to be within a range from 5 inches to 24 inches, and the height Ht (the distance from the plate cover bottom 116 to the plate cover top 112) to be within a range from 2 inches to 10 inches. The thickness Th (the distance between the plate cover first side 120 and the plate cover second side 122) of the plate cover 102 can be within a range from 1/32 inches to 1/2 inches.

At least a portion of the sidewalls 114 of a plate cover 102 can be straight, tapered, stepped, undulated, etc. For example, with a tapered sidewall 114, the inner diameter ID and/or the outer diameter OD of a plate cover 102 can widen or narrow as the sidewall 114 extends from the plate cover bottom 116 to the plate cover top 112. The taper of the inner diameter ID can be the same as or different from the taper of the outer diameter OD. For example, the inner diameter ID may exhibit a taper while the outer diameter OD is straight. As another example, the inner diameter ID may taper in one direction but the outer diameter OD tapers in another direction. It is understood that the taper (or other non-straight shape) will cause the inner diameters ID and/or outer diameters OD to vary as the sidewall 114 extends from the plate cover bottom 116 to the plate cover top 112. Thus, the criteria of the inner diameter ID of one plate cover 102 being greater than the outer diameter OD of another plate cover 102 pertains to at least a portion of the plate cover 102 so as to allow for a nested engagement, or at least a partial nested engagement, between the two.

Some embodiments of the system 100 can include a base 124. The base 124 can be a planar object, much like a plate or a dish. It is contemplated for the system 100 to be able to rest upon the base 124 when in the protracted configuration 104 and/or in the collapsed configuration 106.

In some embodiments, the sidewalls 114 of a plate cover 102 can a base-engaging portion 126. This can be a flare, a step-configuration, a cuff, etc. at or near the plate cover bottom 116. The base-engaging portion 126 can facilitate the plate cover 102 to be slid over and engage a rim 128 portion of the base 124. This can also allow the base-engaging portion 126 of one plate cover 102 to slide over and engage the base-engaging portion 126 of another plate cover 102. For example, at least the first plate cover 102 can have a sidewall 114 that is straight as it extends from the first plate cover top 112 and leads into a step-configuration at or near the first plate cover bottom 116. The first plate cover 102 can be used to slide over the base 124 so that its step-configuration engages a rim 128 portion of the base 124. The second plate cover 102, third plate cover 102, etc. can have similar step-configurations to allow them to slide over the first plate cover 102 in the nested manner described herein. Thus, each of the base-engaging portions 126 of the first, second, and third plate covers 102 can engage each other and the rim 128 of the base 124. The engagement means of the base-engaging portion 126 of each plate cover 102 can allow for stacking of the plate covers 102 and/or resting of the plate covers 102 on the base 124 with minimal or no lateral motion of the plate covers 102, thereby enhancing the stability of the system 100.

Figure 5:
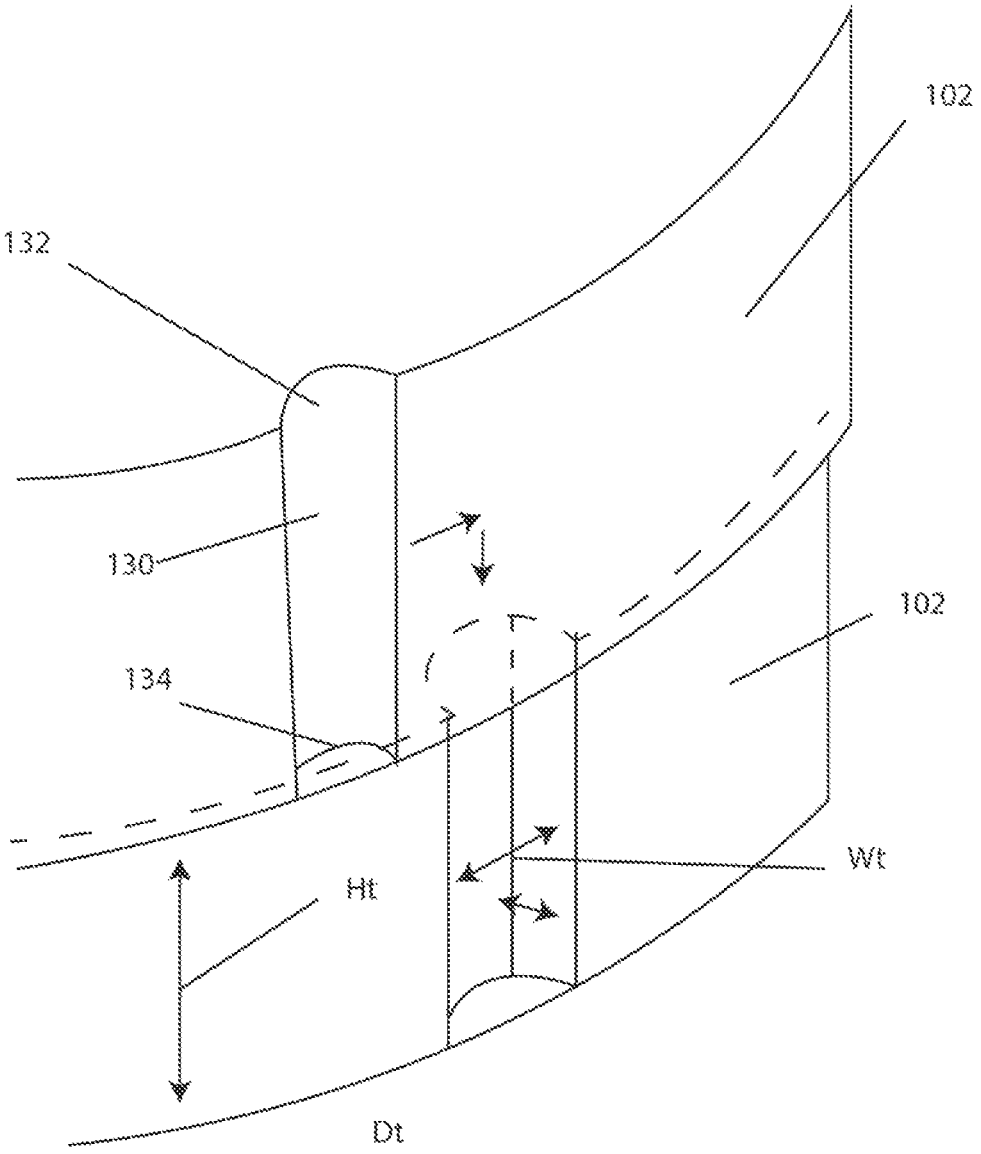
FIG. 5 shows a close up view of an exemplary channel in sidewalls of two plate covers.
Figure 6:
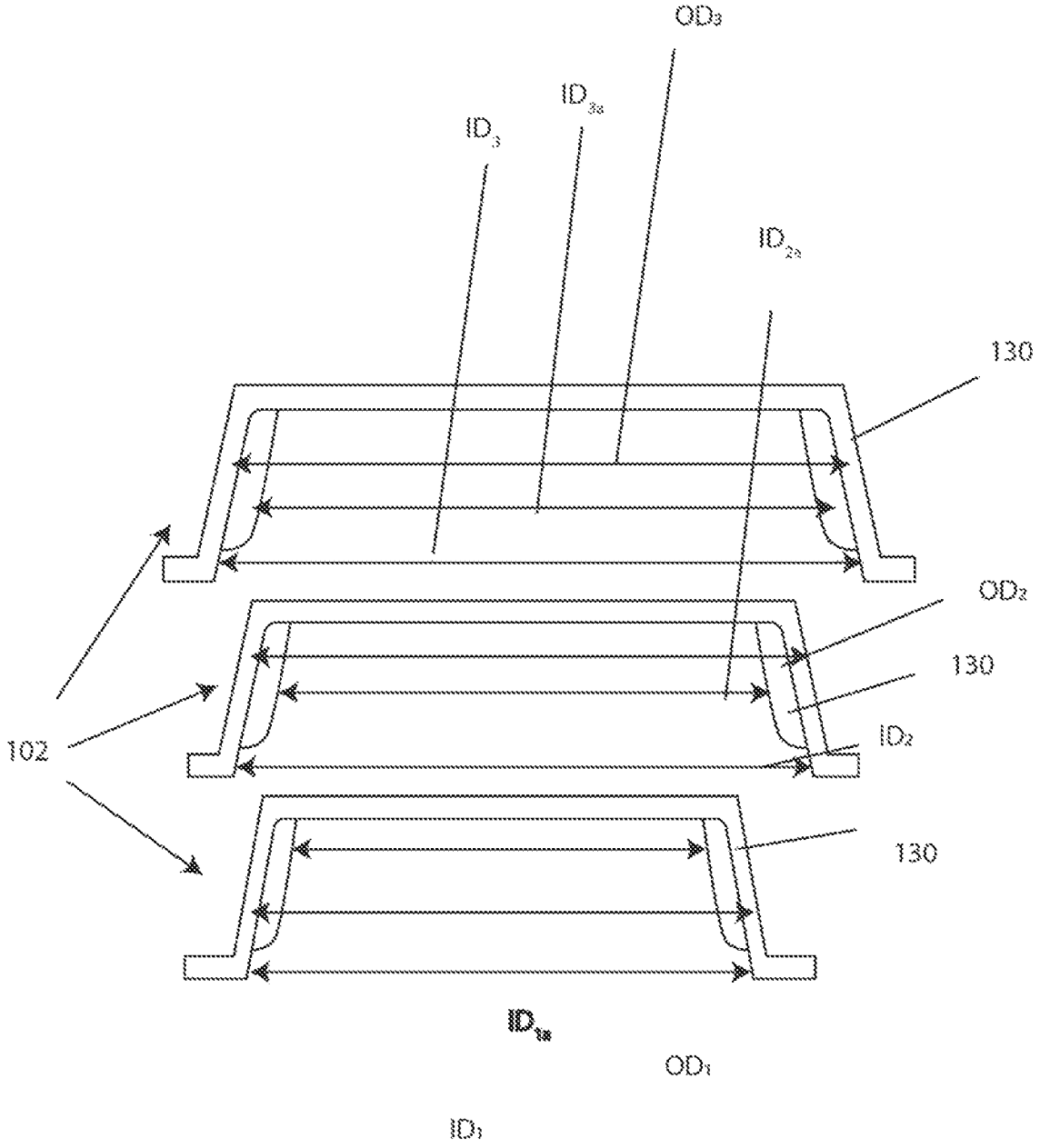
FIG. 6 shows cross-sectional views along the B-B line of embodiments of three plate covers to illustrate exemplary relative inner and outer diameters of the plate covers.
Figure 7:
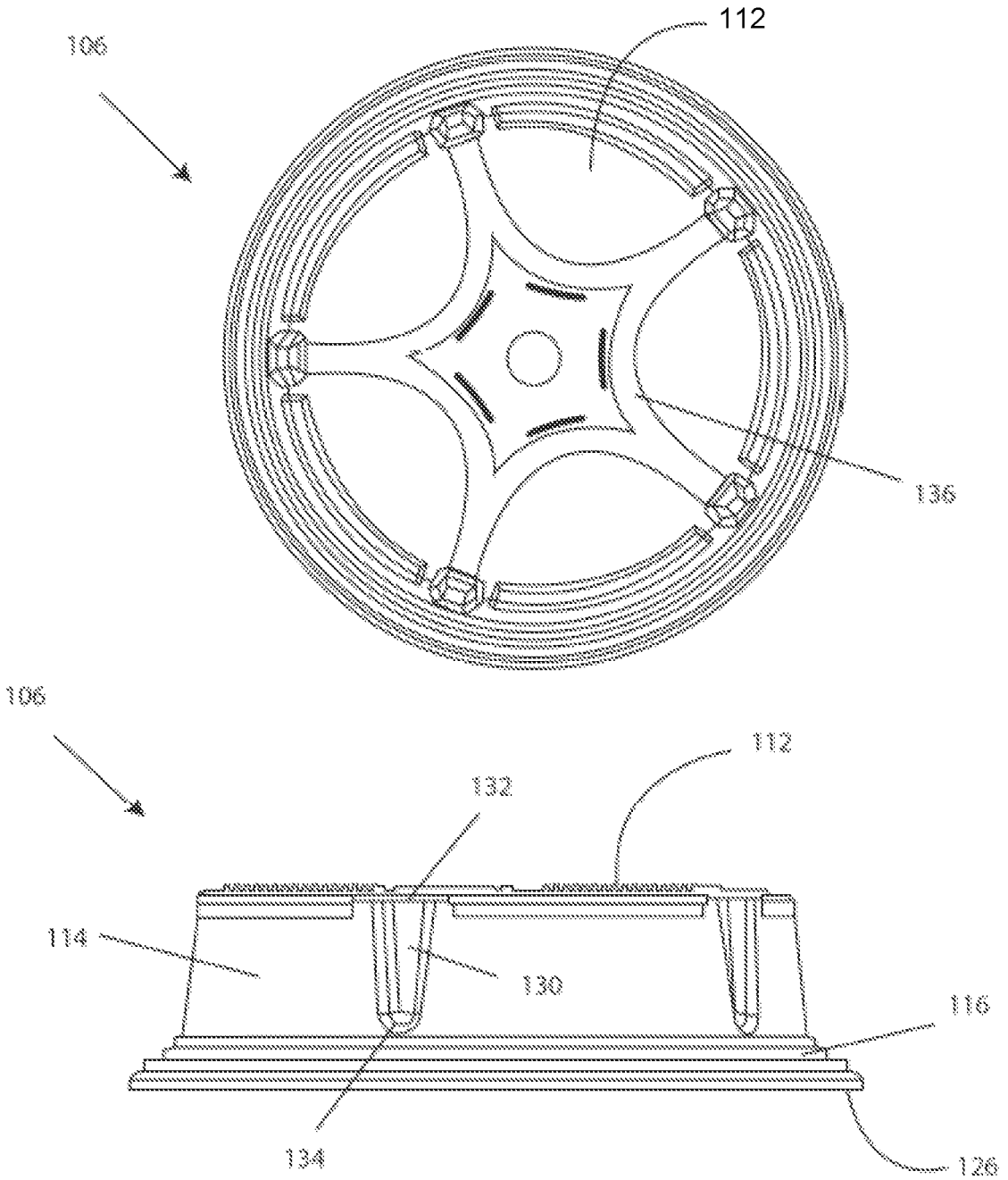
FIGS. 7-9 show various views of an exemplary large sized plate cover system.
Figure 8:
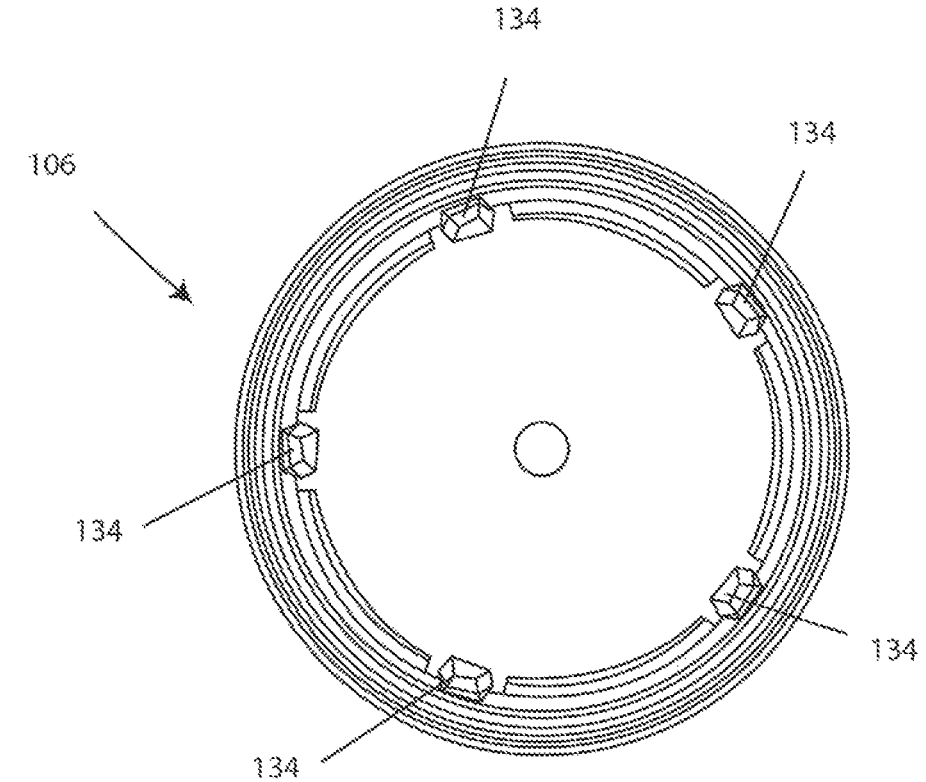
Figure 8:
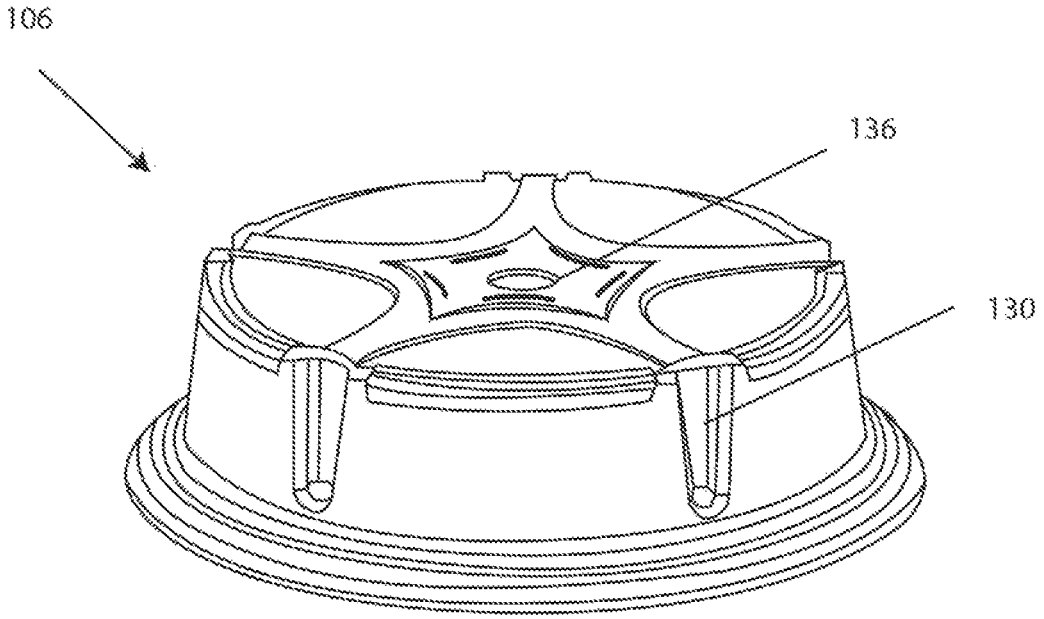
Figure 9:
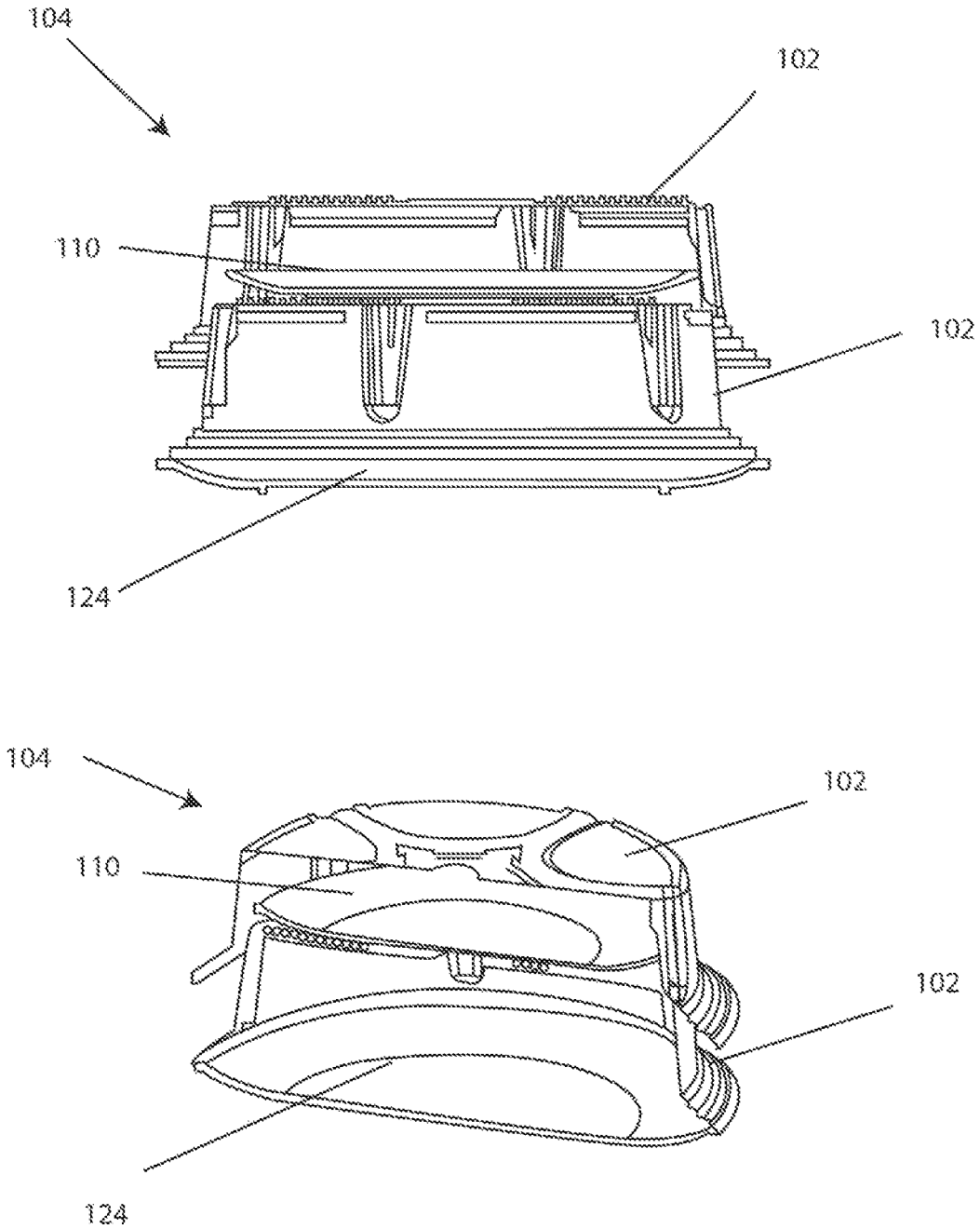
Figure 10:
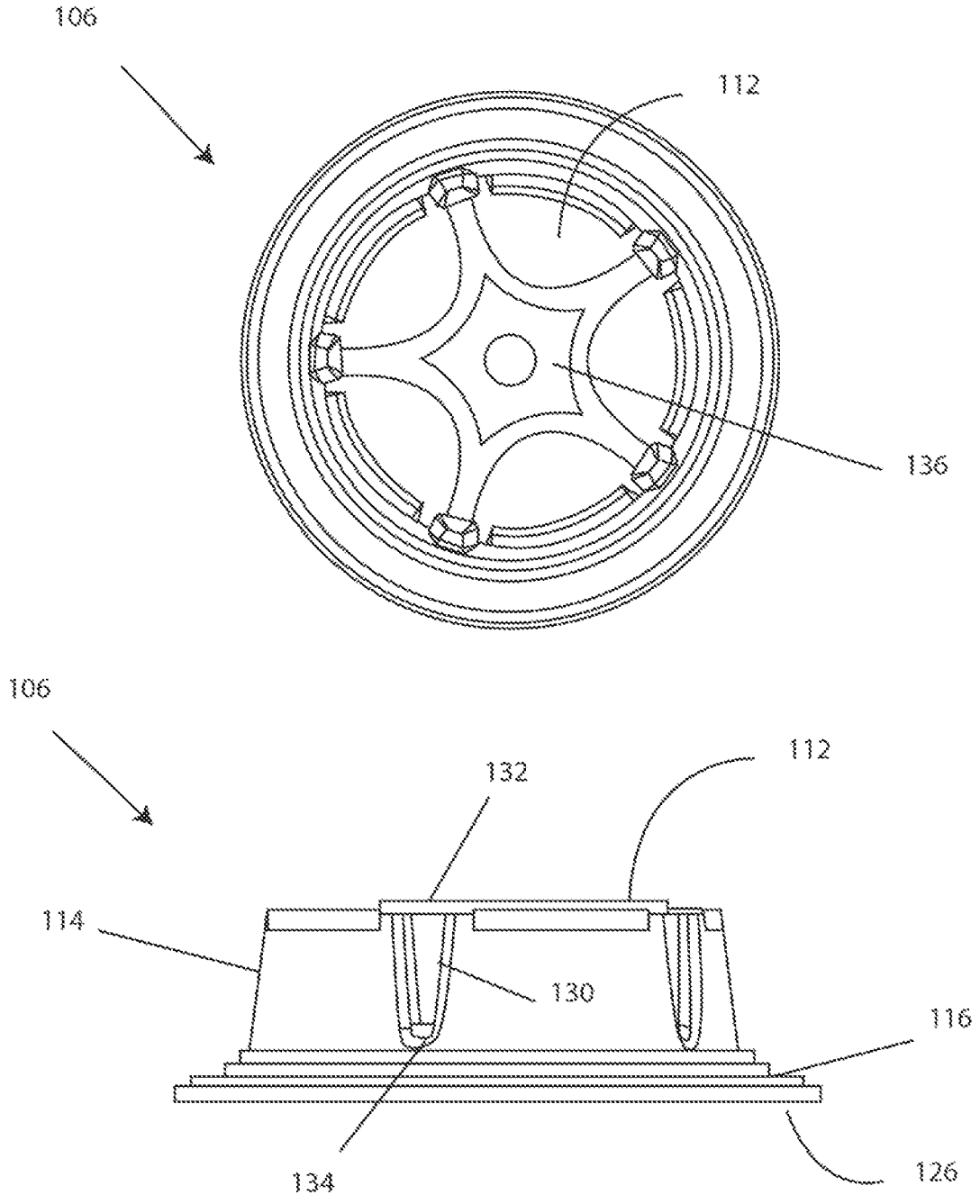
FIGS. 10-12 show various views of an exemplary small sized plate cover system.
Figure 11:
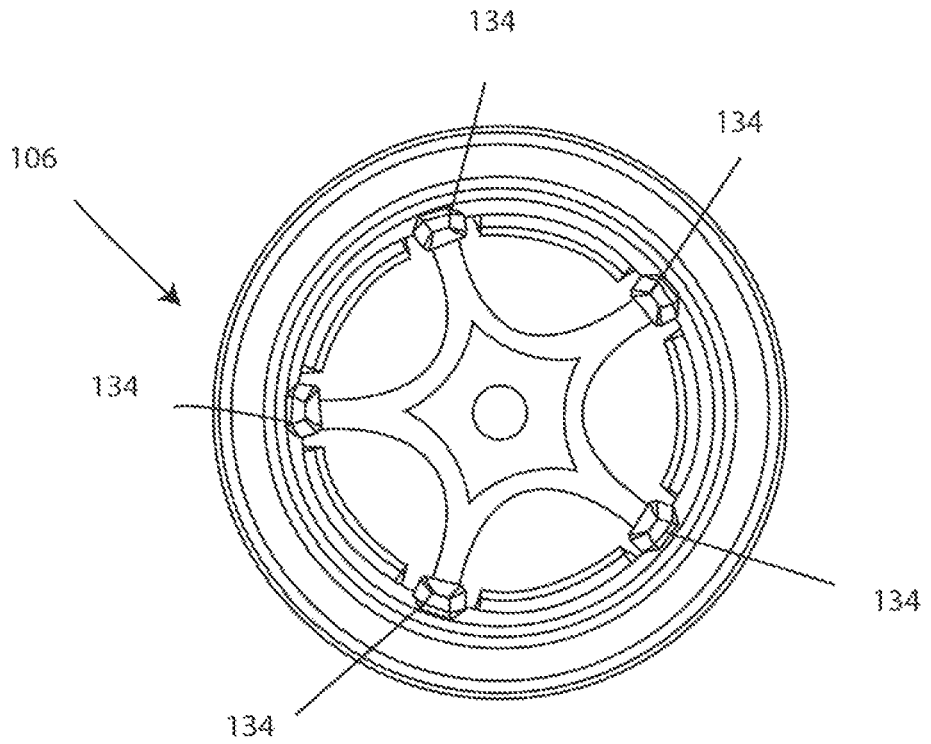
Figure 11:
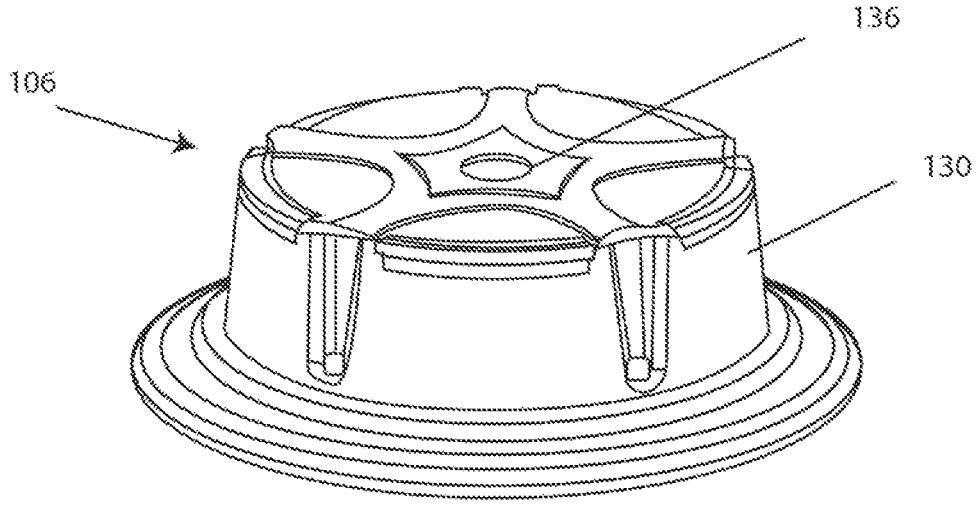
Figure 12:
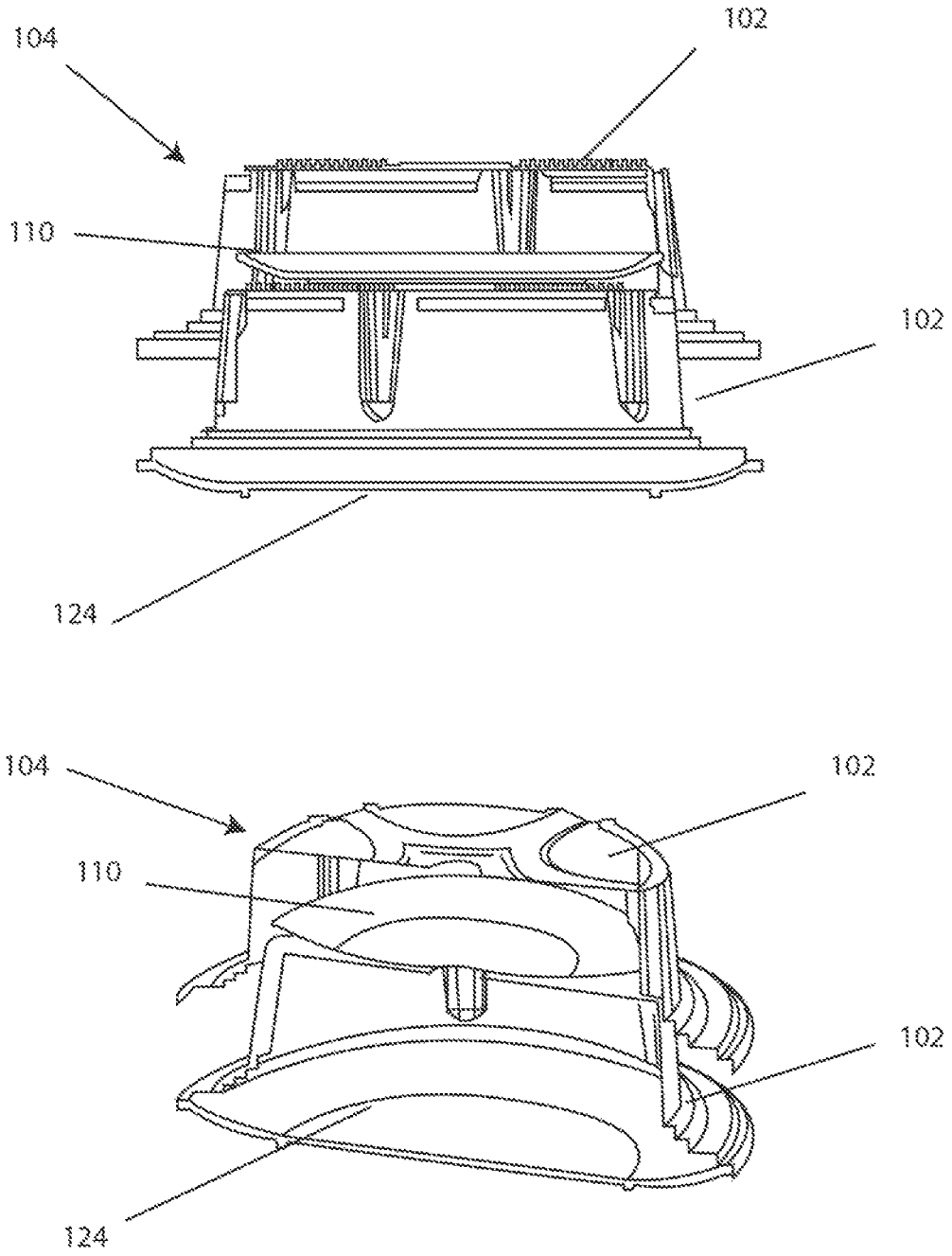
Figure 13:
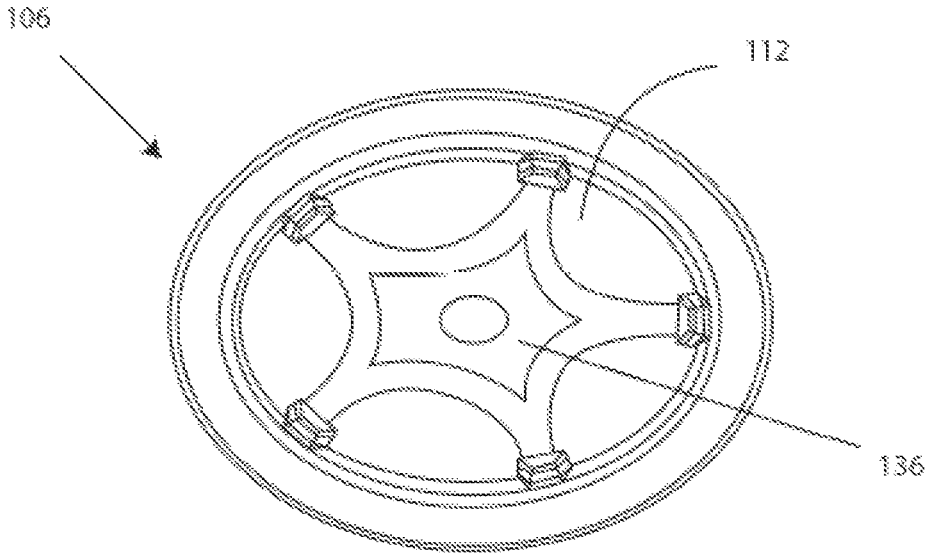
FIGS. 13-15 show various views of an exemplary oval shaped plate cover system.
Figure 13:
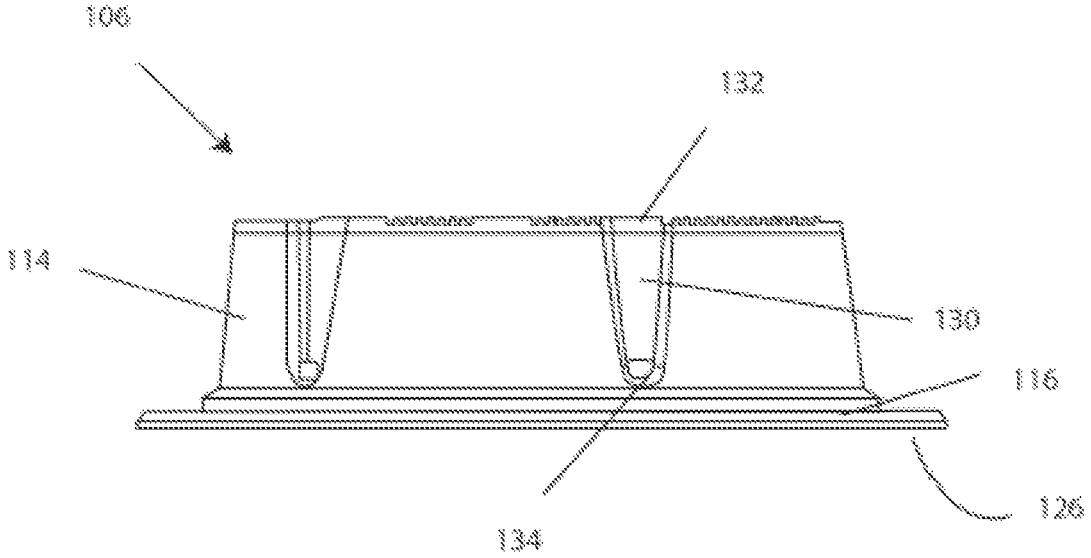
Figure 14:
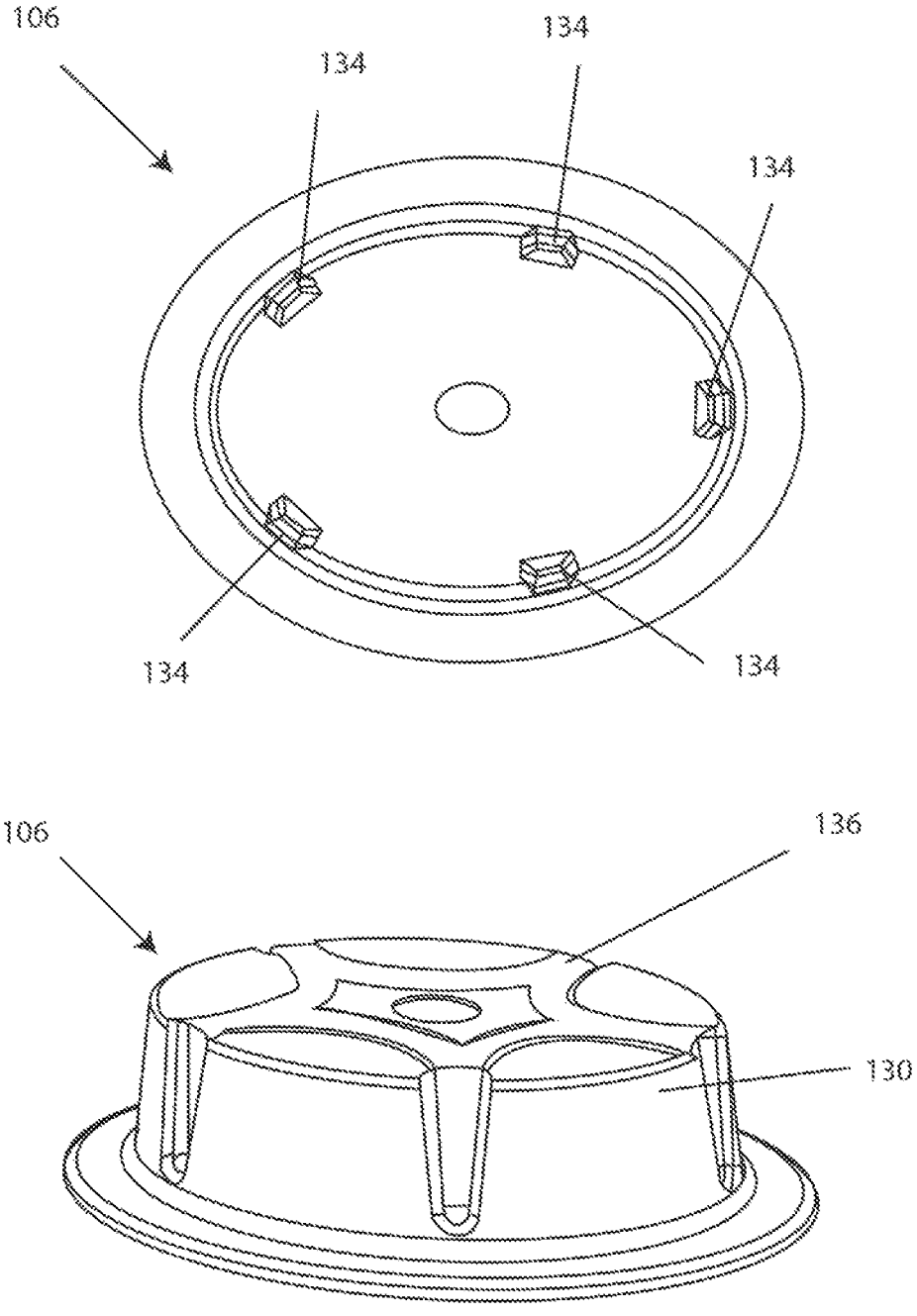
Figure 15:
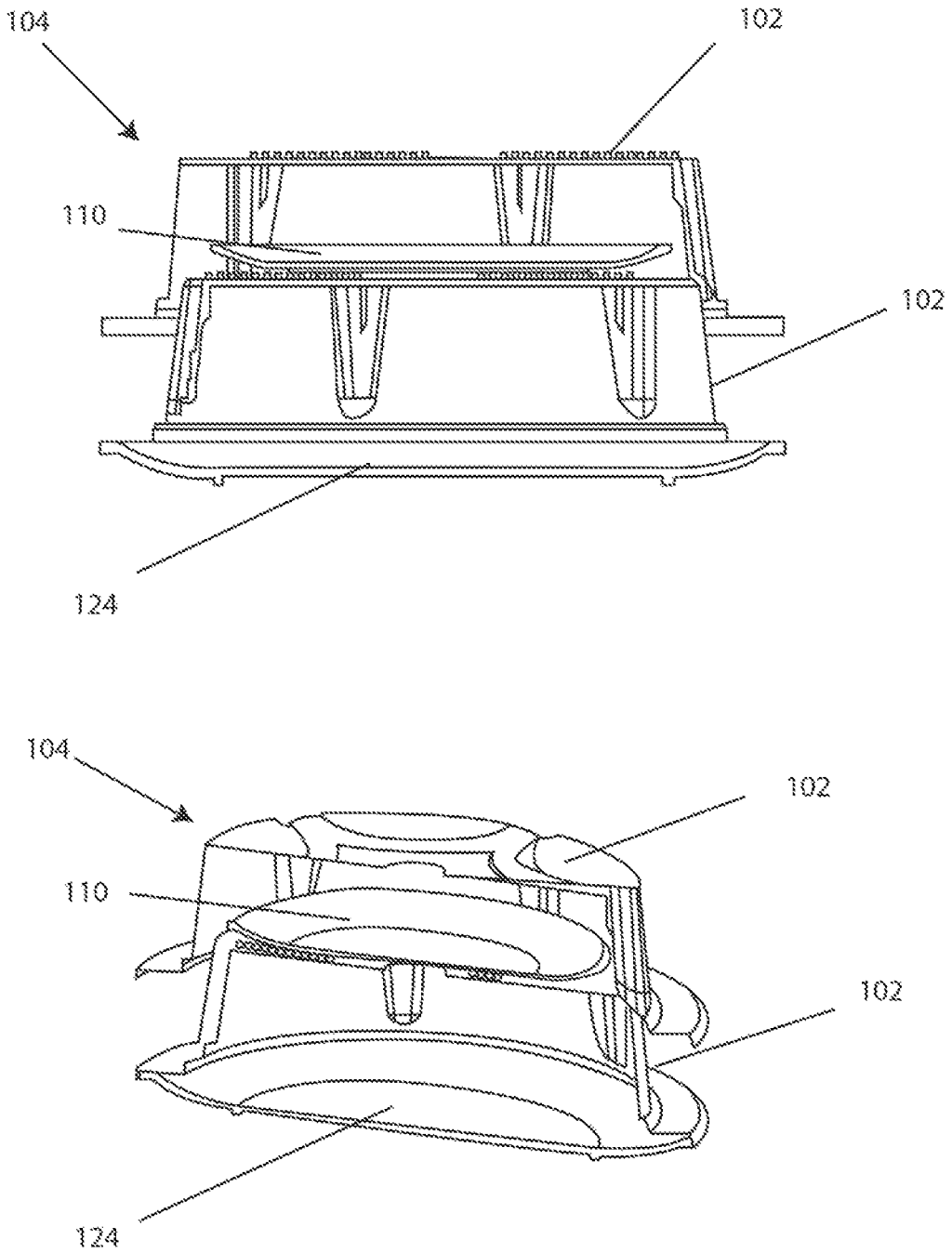
Figure 16:
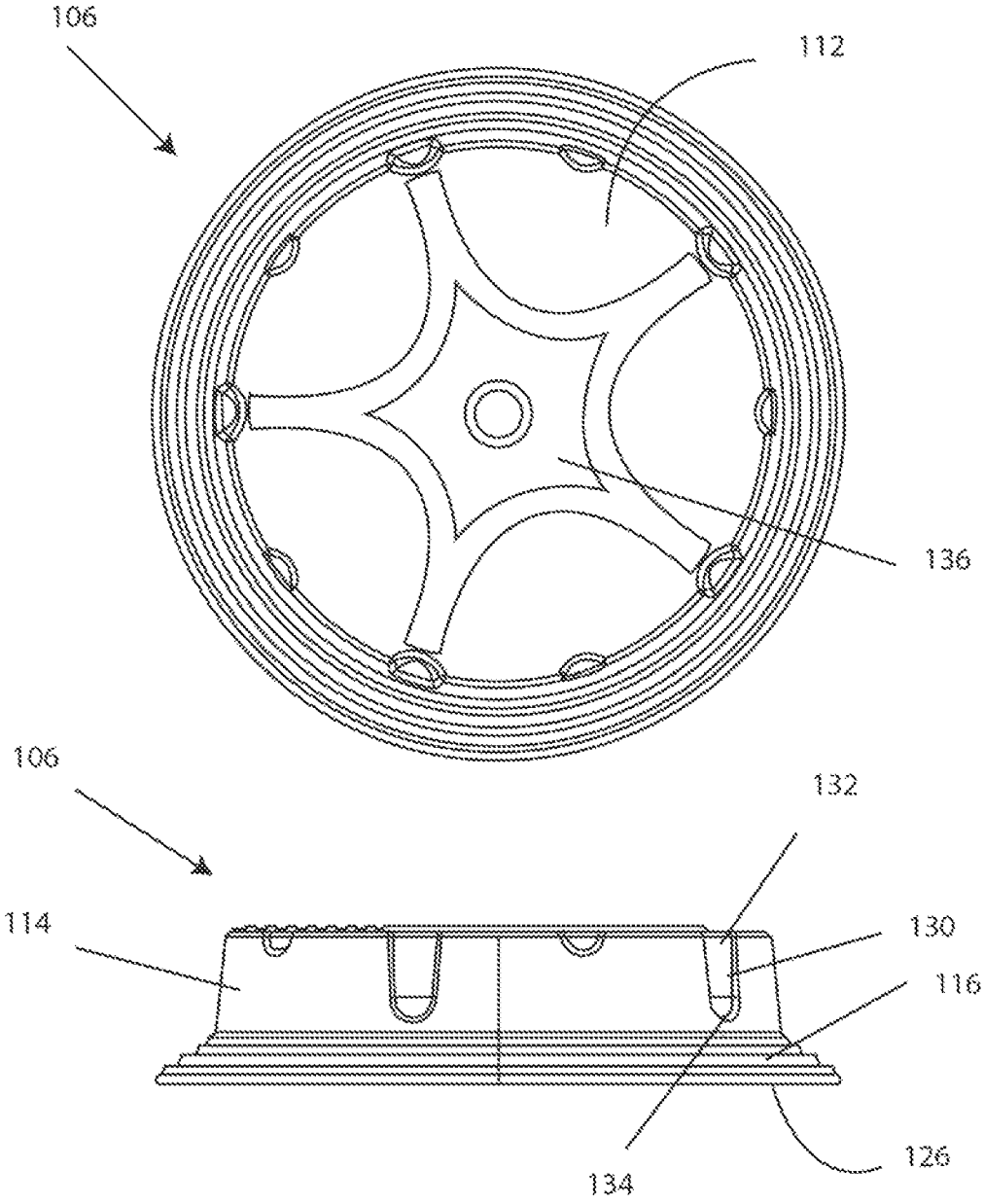
FIGS. 16-18 show various views of an exemplary plate cover system, wherein each plate cover is made of stainless steel.
Figure 17:
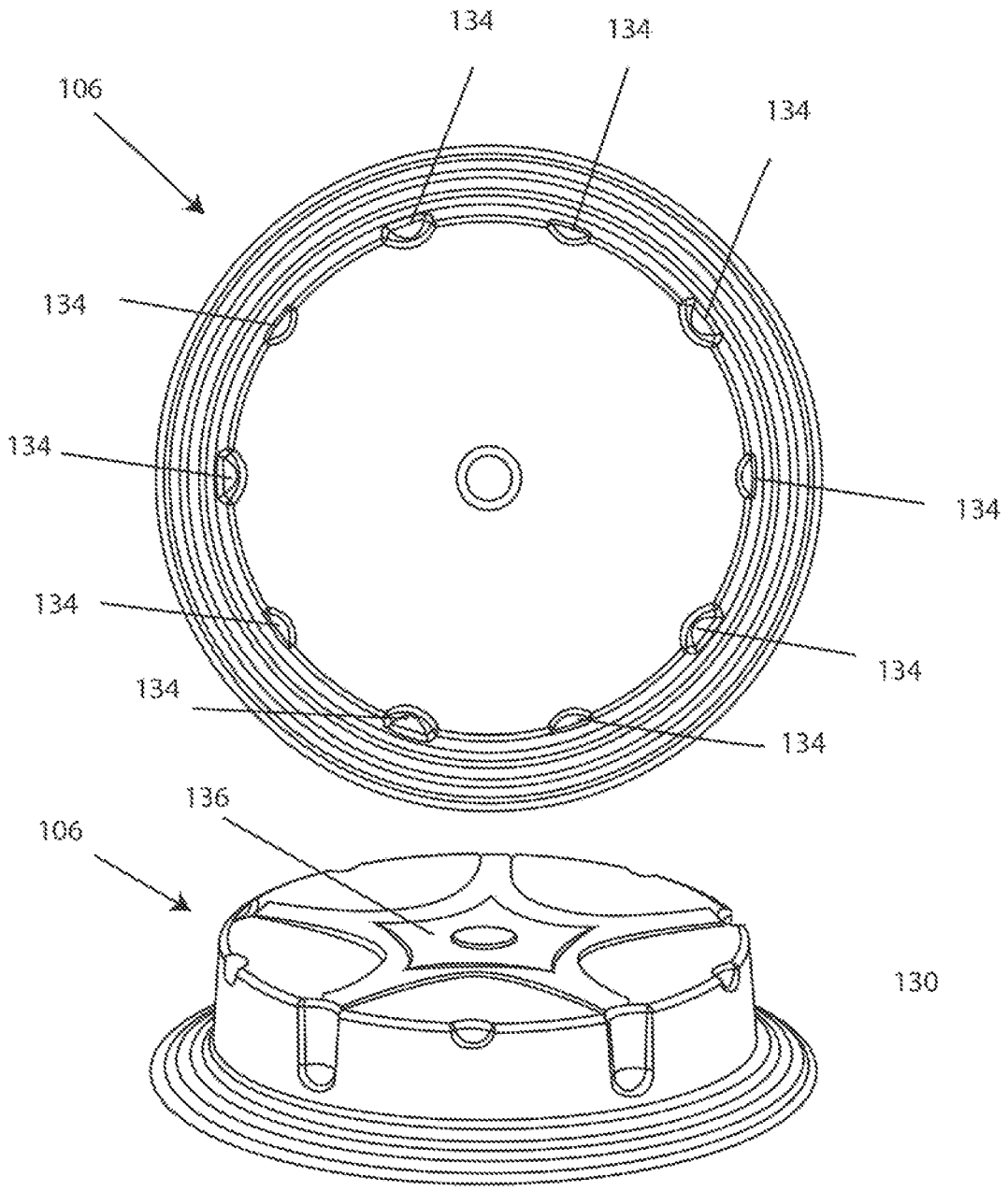
Figure 18:
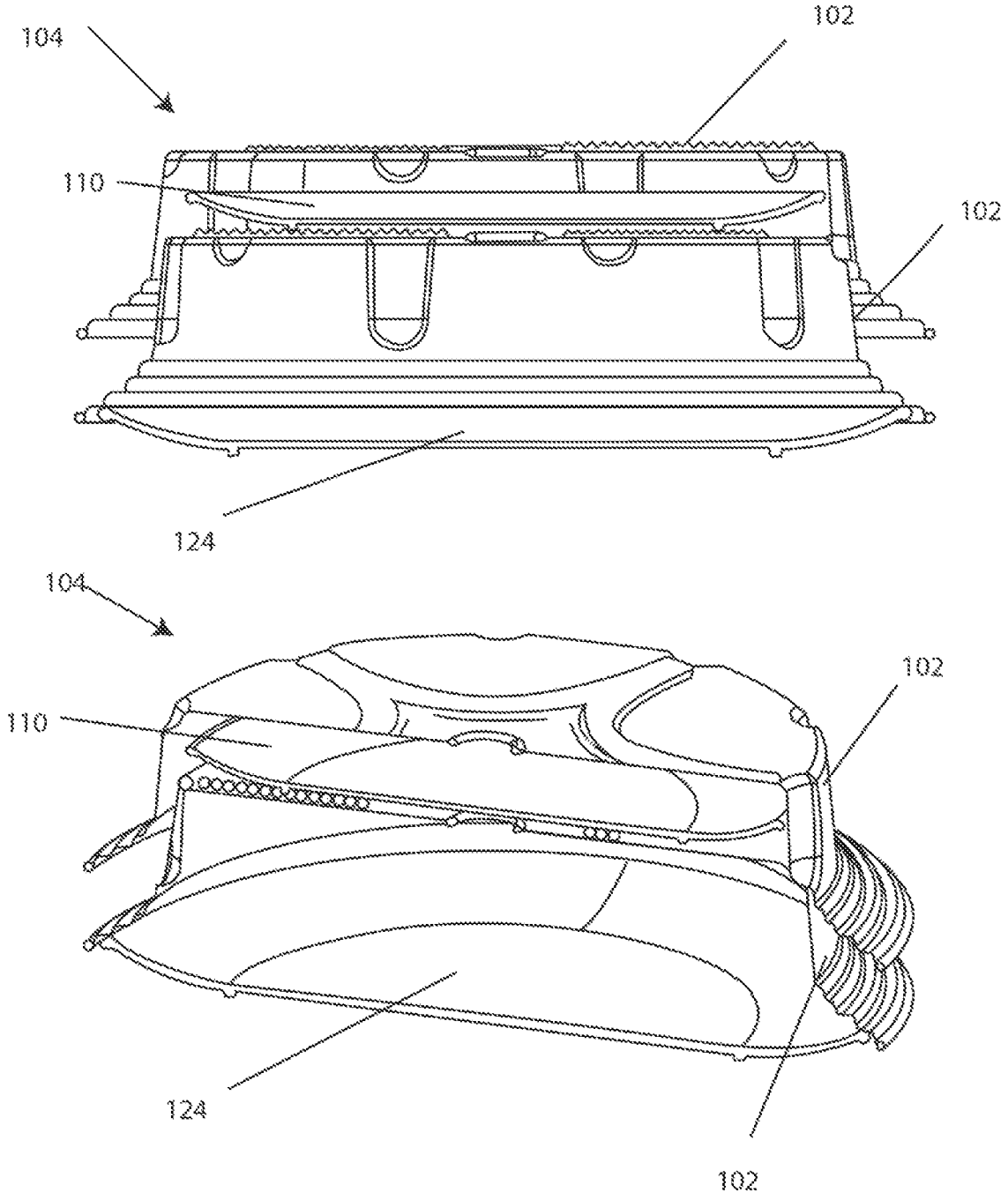
Figure 19:
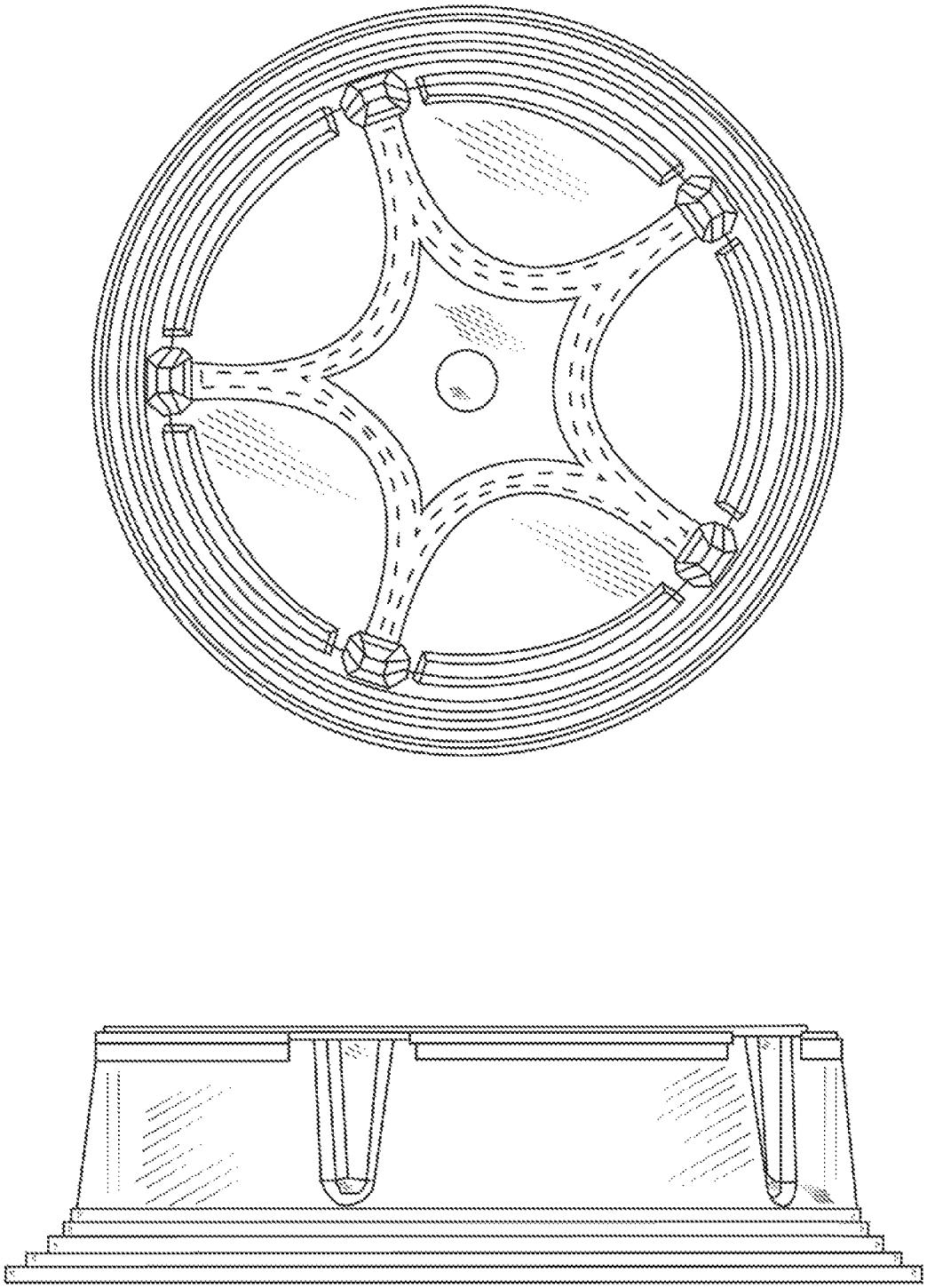
FIGS. 19-30 shows various views of exemplary large, small, oval, and stainless steel plate cover systems of FIGS. 7-18.
Figure 20:
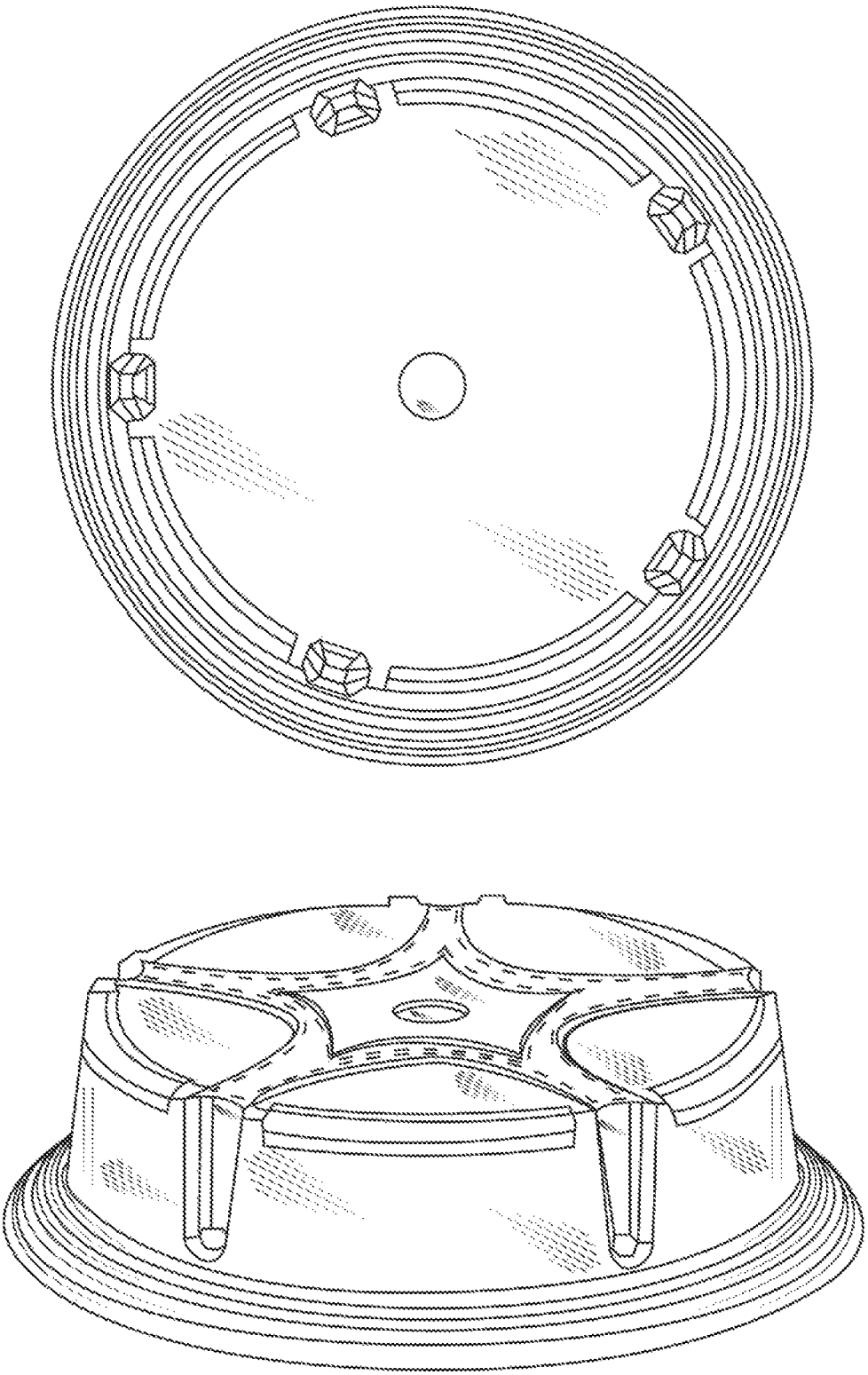
Figure 21:
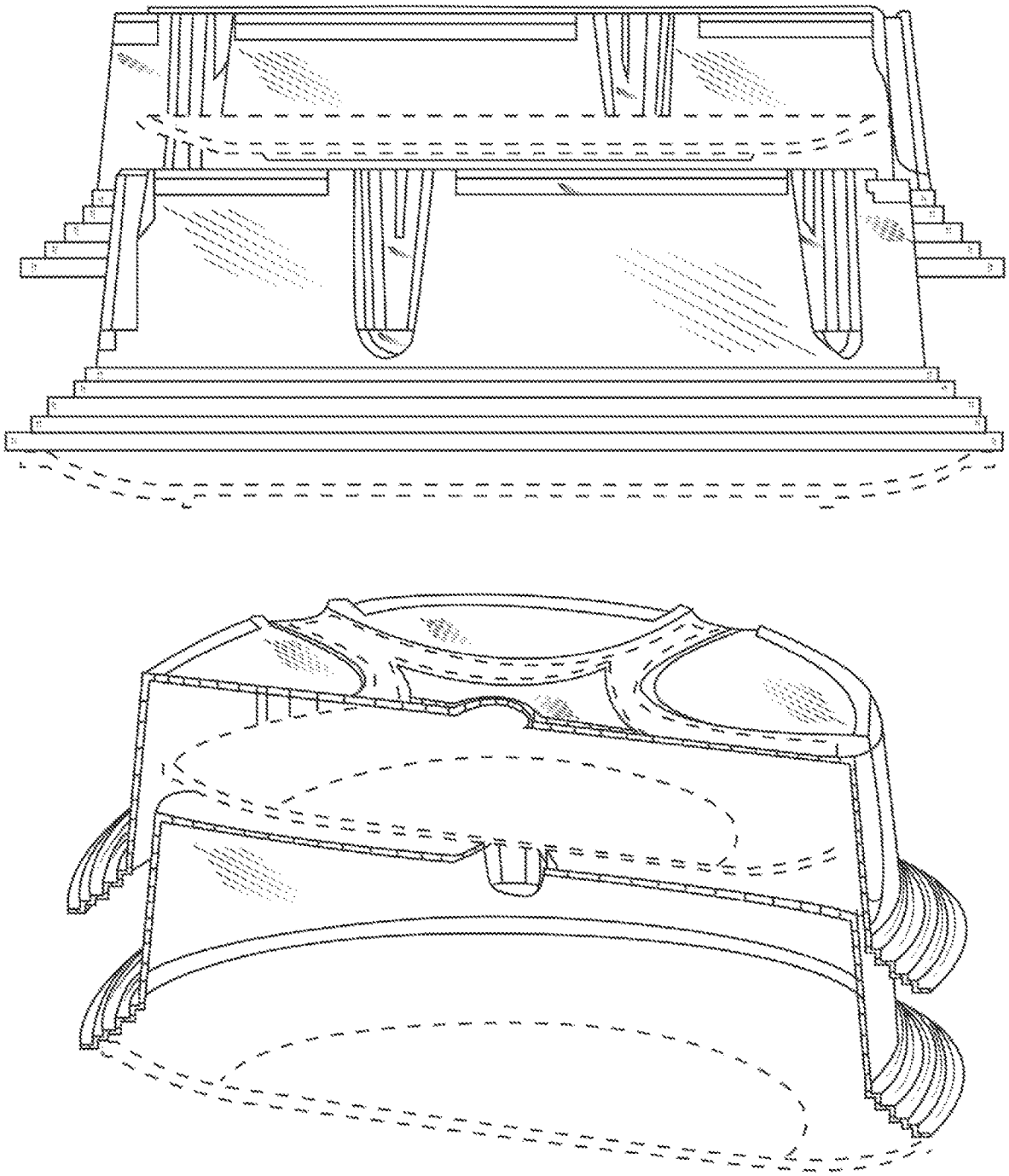
Figure 22:
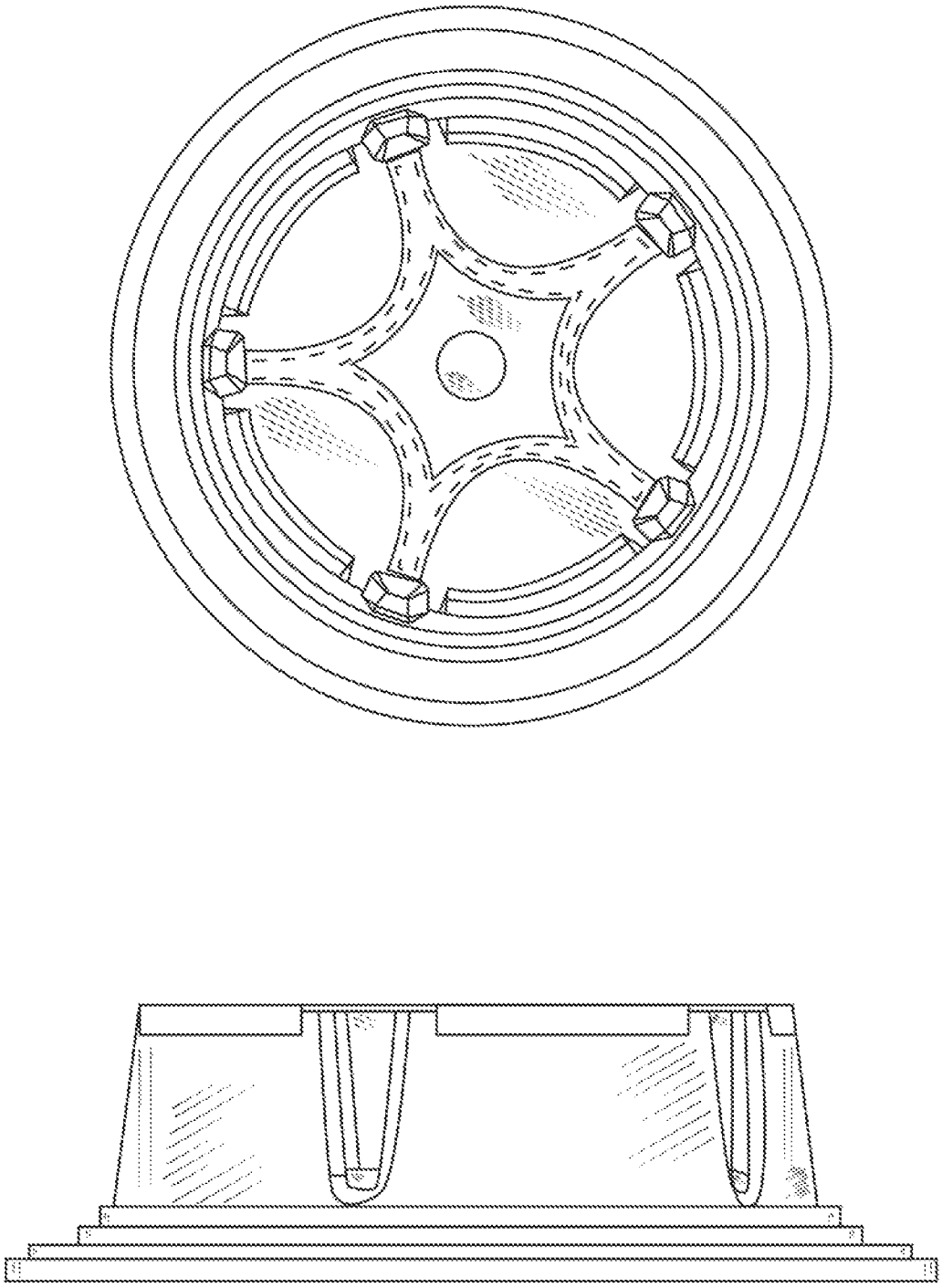
Figure 23:
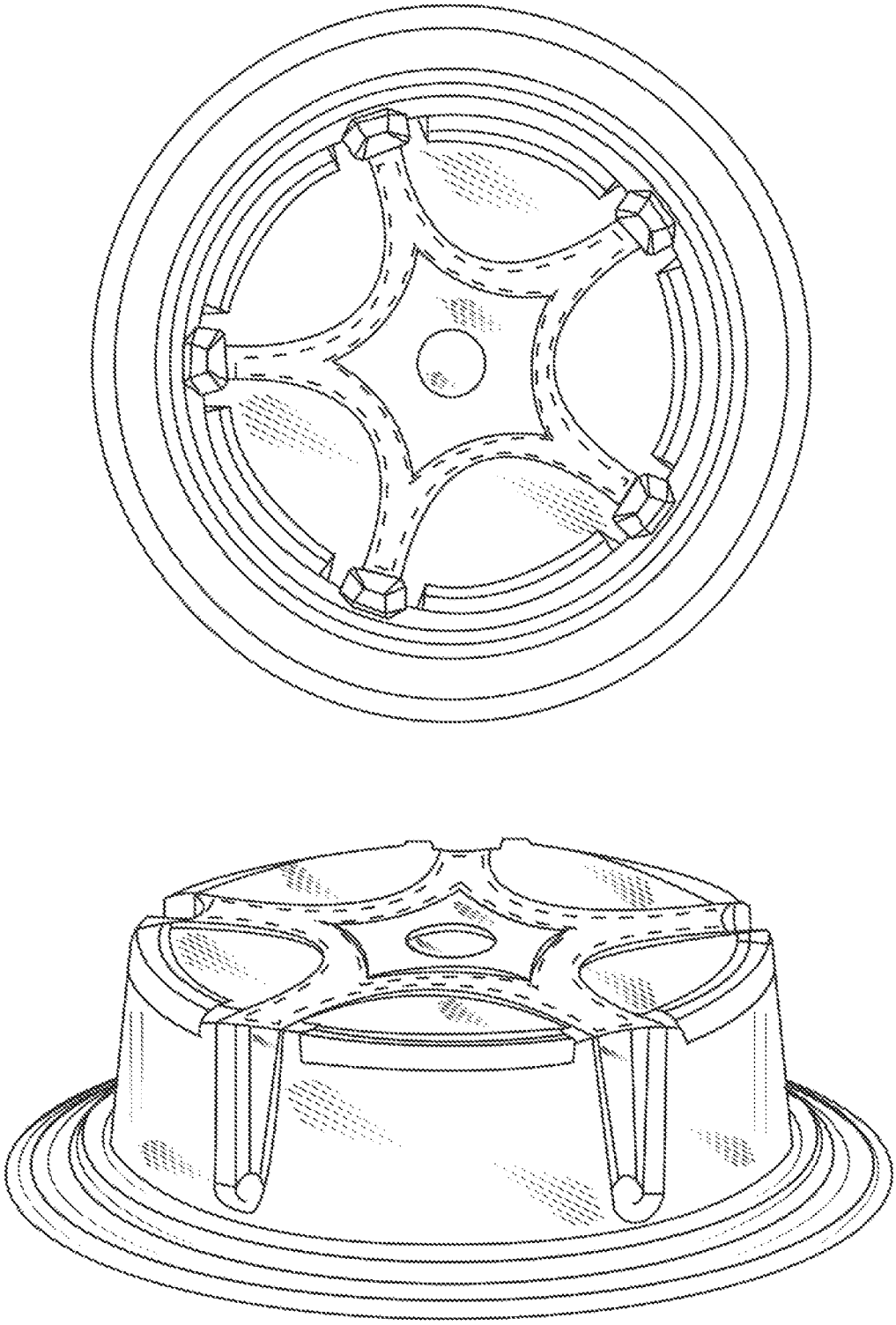
Figure 24:
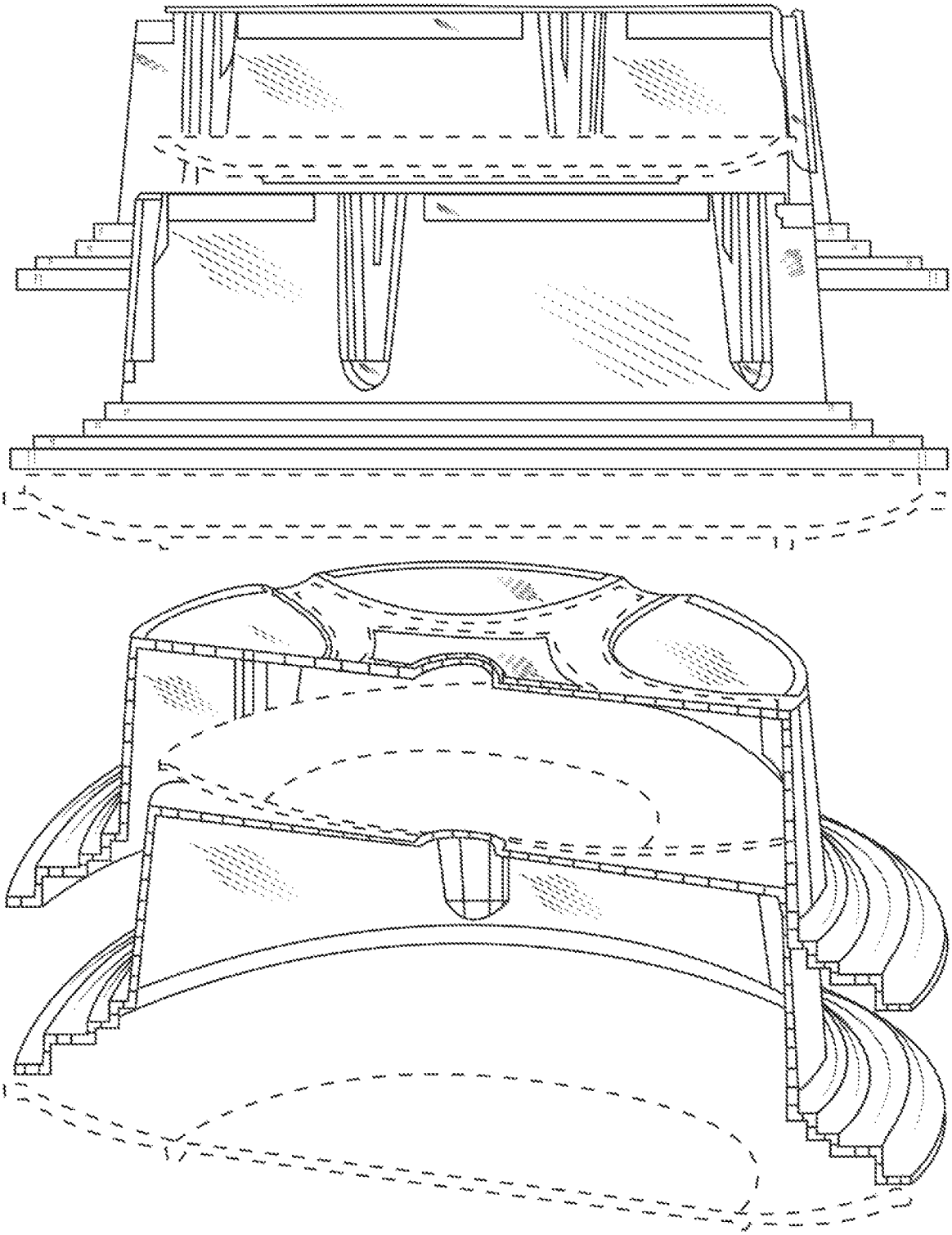
Figure 25:
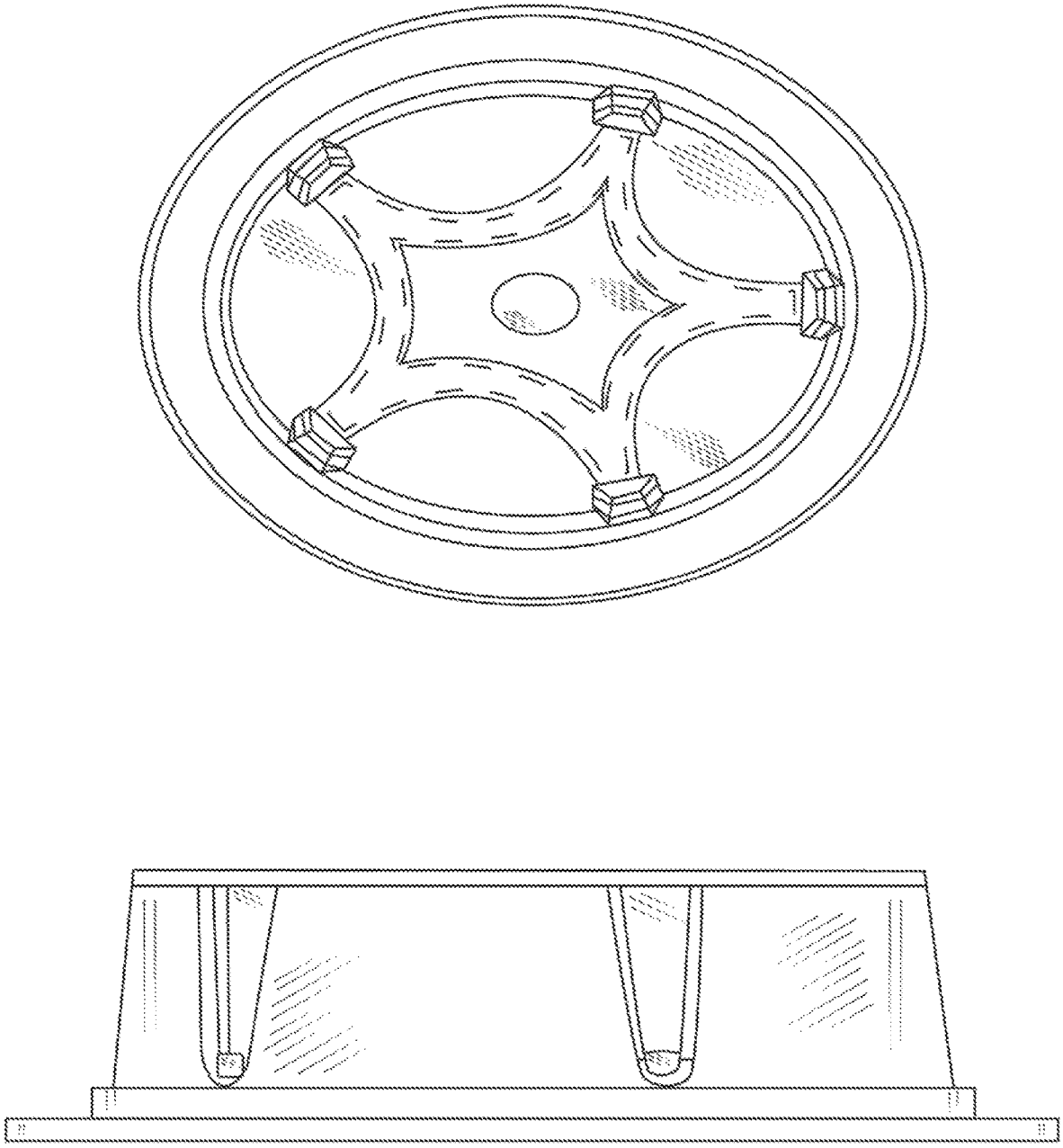
Figure 26:
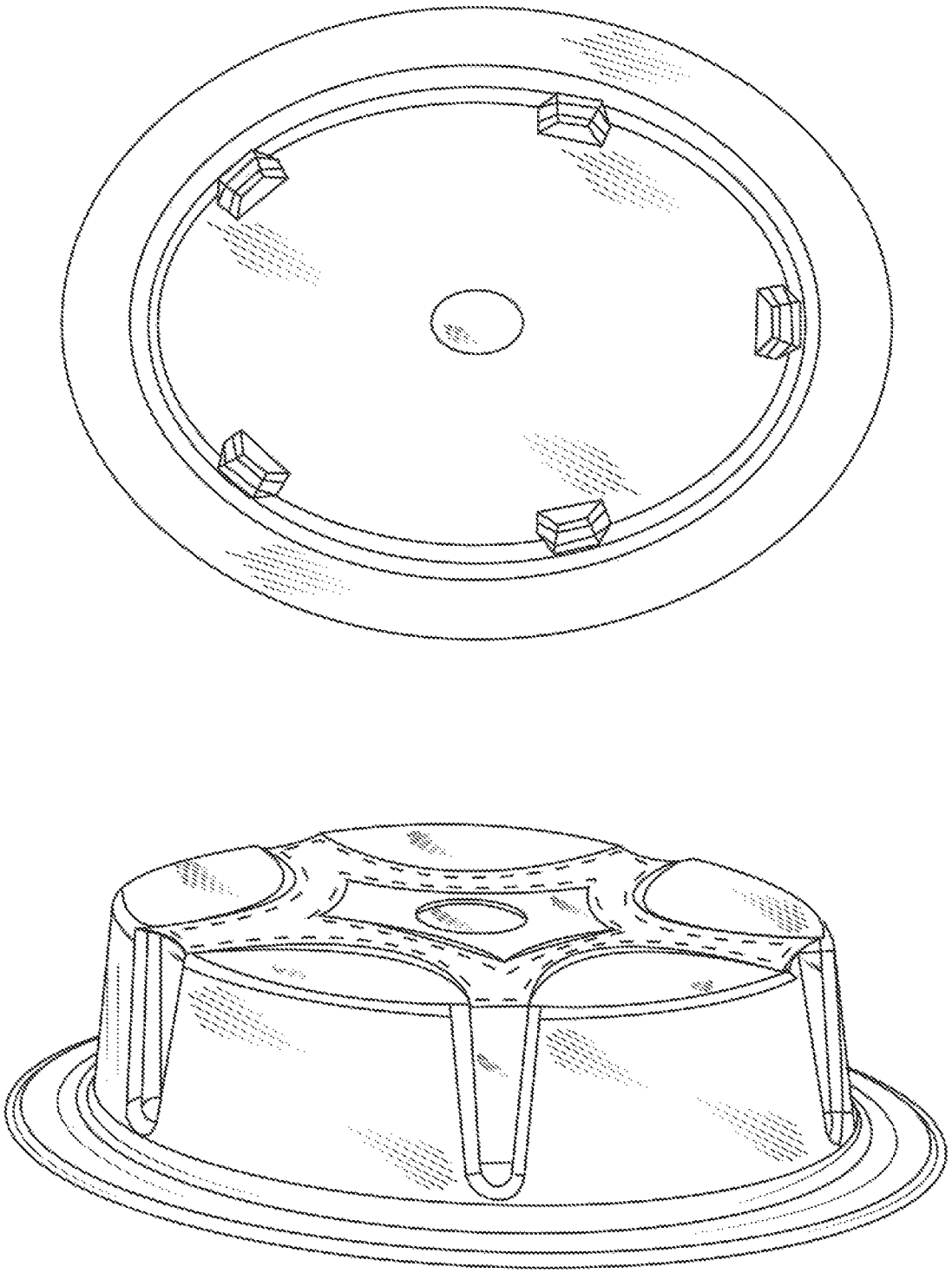
Figure 27:
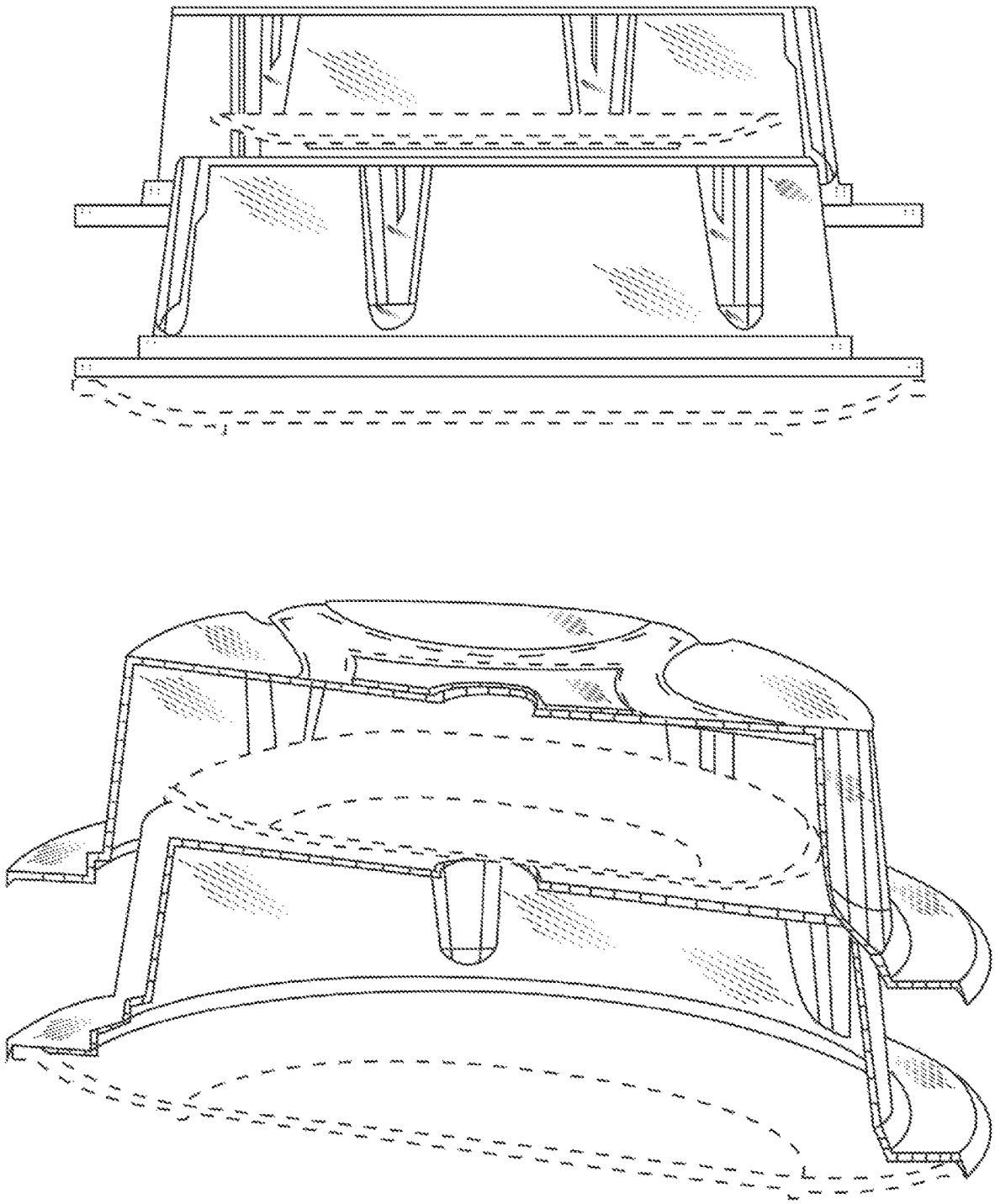
Figure 28:
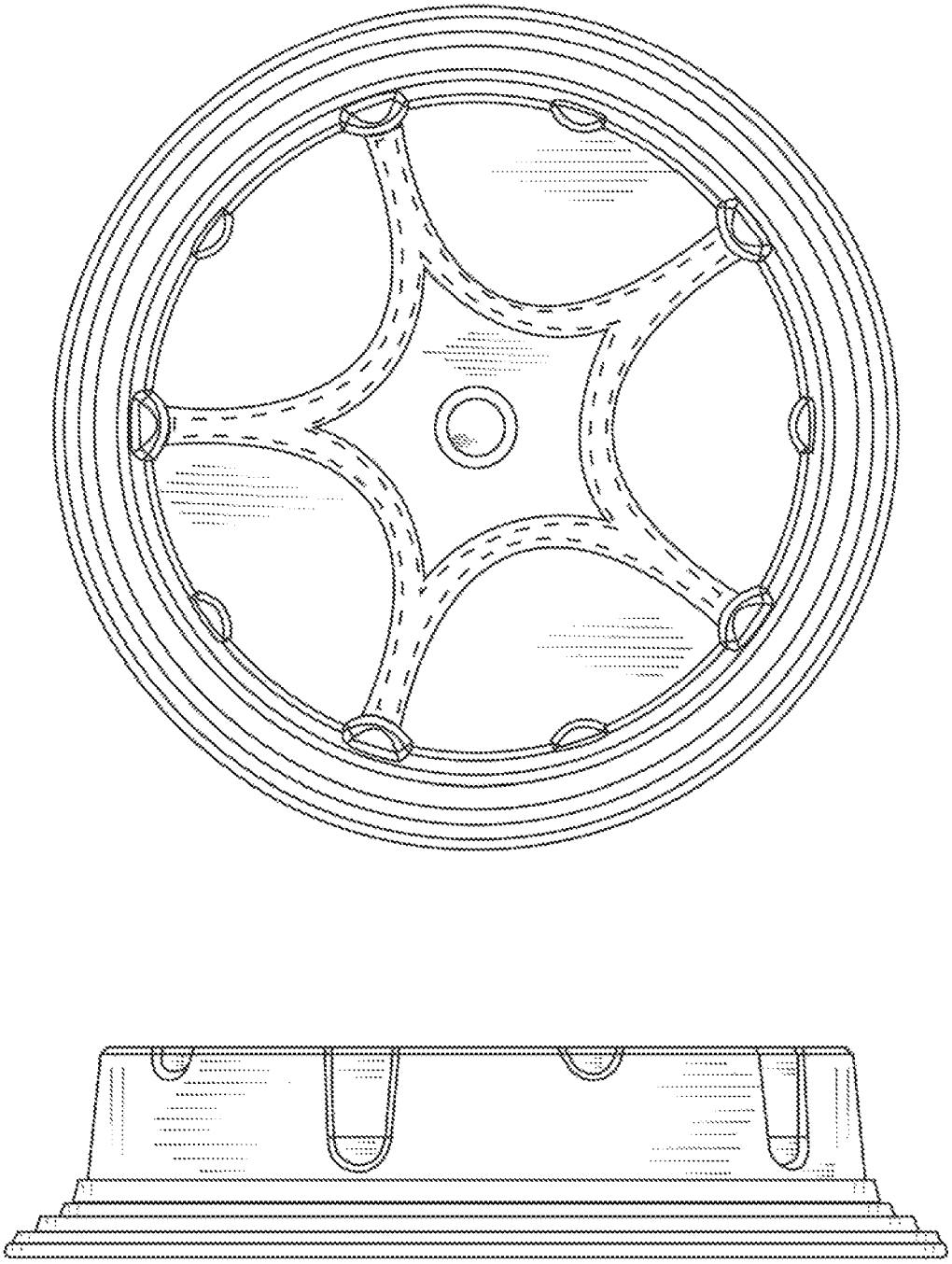
Figure 29:
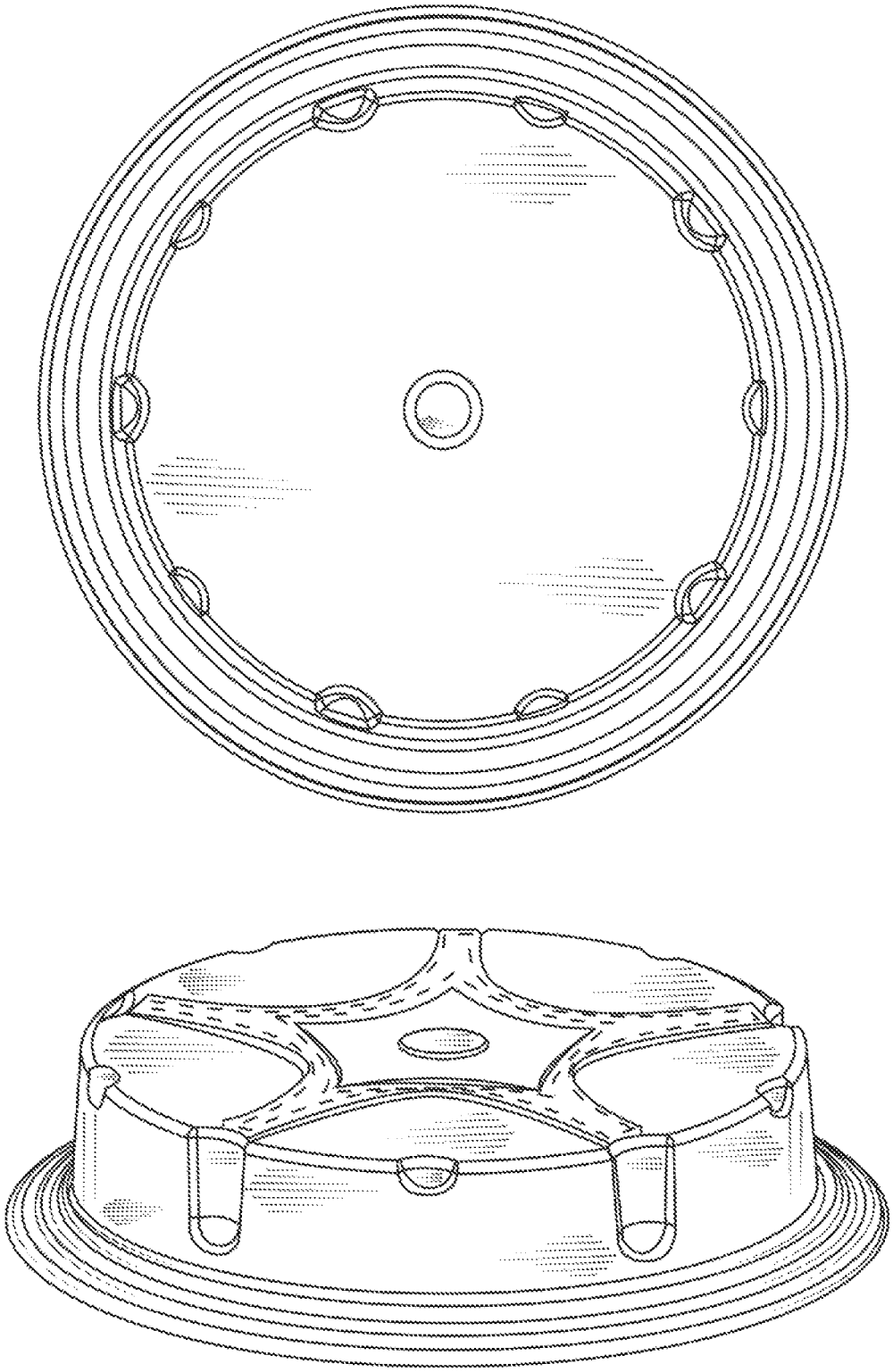
Figure 30:
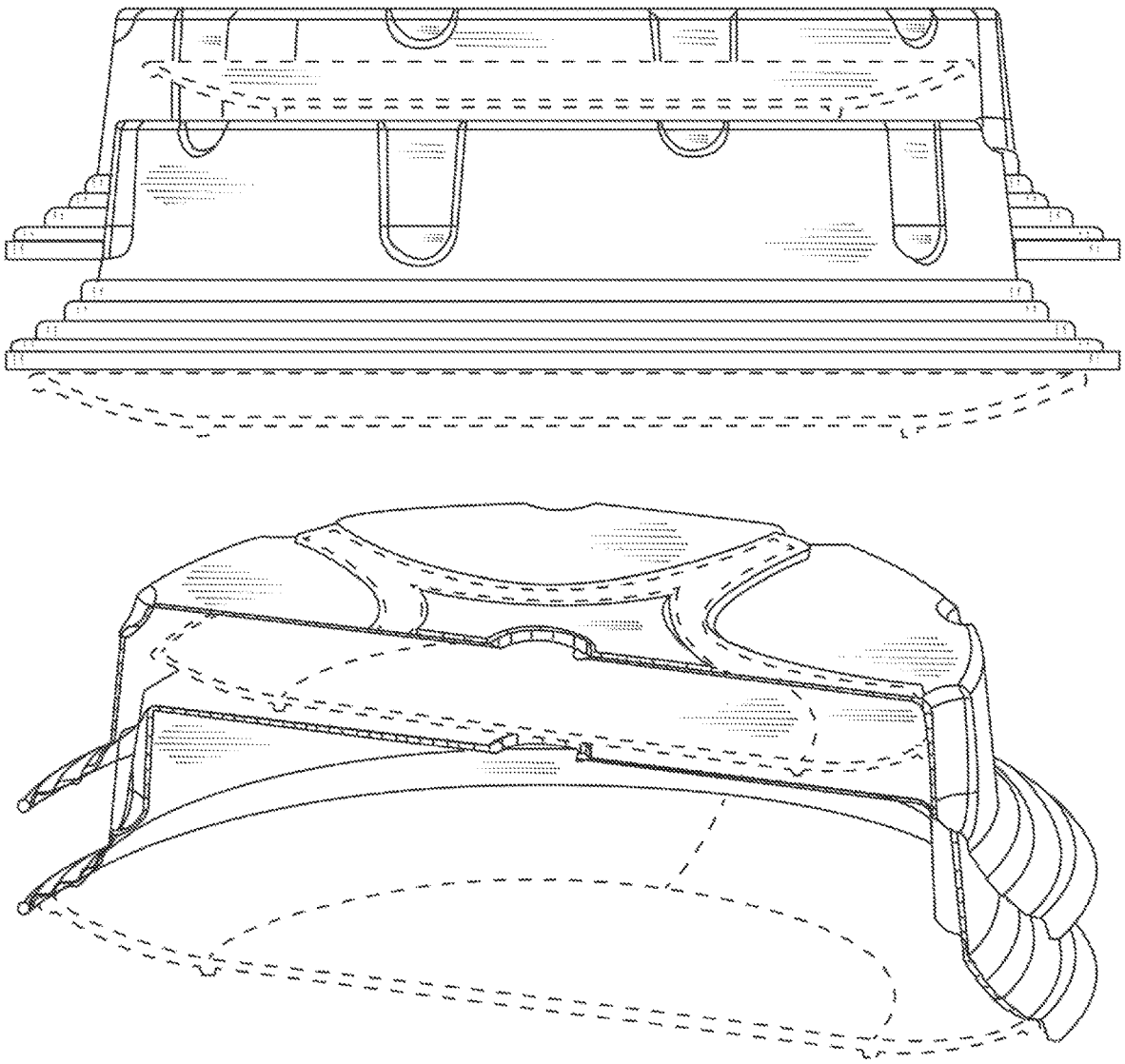

Referring to FIGS. 5-6, at least one plate cover 102 can have at least one channel 130 formed in the plate cover sidewalls 114. The channel 130 can extend vertically (e.g., running in a direction from the plate cover top 112 to the plate cover bottom 116). It is contemplated for the channel 130 to run from the plate cover top 112 to a portion of the sidewall 114 at or near the plate cover bottom 116. For example, the channel 130 can run from the plate cover top 112 to a portion of the plate cover sidewall 114 adjacent the base-engaging portion 126. The channel 130 can be a groove, indentation, guide, etc. formed into the plate cover sidewall 114 so as to decrease the inner diameter ID and the outer diameter OD of the plate cover 102 at the portion of the channel 130, thereby forming a depth Dt of the channel 130. Any one or combination of plate covers 102 can have any number of channels 130. Plate covers 102 having more than one channel 130 can have channels 130 formed in the plate cover sidewalls 114 so as to be spaced equidistant to each other or spaced in another manner. Any one or combination of the channels 130 can be straight or tapered. For example, a width Wt and/or the depth Dt of the channel 130 can widen or narrow as it extends from the plate cover top 112 to the plate cover bottom 116.

For example, the first plate cover 102 can have a first plate cover first channel 130, a first plate cover second channel 130, a first plate cover third channel 130, a first plate cover fourth channel 130, and a first plate cover fifth channel 130 spaced equidistant from each other. The second plate cover 102 can have a second plate cover first channel 130, a second plate cover second channel 130, a second plate cover third channel 130, a second plate cover fourth channel 130, and a second plate cover fifth channel 130 spaced equidistant from each other. The third plate cover 102 can have a third plate cover first channel 130, a third plate cover second channel 130, a third plate cover third channel 130, a third plate cover fourth channel 130, and a third plate cover fifth channel 130 spaced equidistant from each other. The fourth, fifth, sixth, etc. plate covers 102 can be similarly configured.

As noted herein, the plate covers 102 are configured to engage each other in a nested manner. It is also noted that the system 100 can be transitioned between the protracted configuration 104 and the collapsed configuration 106 via the channel 130 arrangement. The transitioning will be explained in detail later, but it should be noted that the channels 130 of a plate cover 102 configured to nest within another plate cover 102 should match or at least complement the channels 130 of its nested plate cover 102 to allow for sliding engagement there-between. In addition, the channels 130 of the first plate cover 102 can have widths Wt and depths Dt that are slightly larger than the channels 130 of the second plate cover 102 to allow the second plate cover channels 130 to slidingly engage the first plate cover channels 130. Similarly, the channels 130 of second plate cover 102 can have widths Wt and depths Dt that are slightly larger than the channels 130 of the third plate cover 102 to allow the third plate cover channels 130 to slidingly engage the second plate cover channels 130. In addition, each channel 130 can have a mouth 132 (e.g., an opening) located at or near the plate cover top 112 and a butt 134 (e.g., a closed off portion) located at or near the plate cover bottom 116. The mouth 132 of a channel 130 on one plate cover 102 can be configured to receive a butt 134 portion of a channel 130 on another plate cover 102. The fourth, fifth, sixth, etc. plate covers channels 130 can be similarly configured.

For example, the first plate cover 102 can have an inner diameter ID of $ID_1$ and an outer diameter of $OD_1$. The first plate cover 102 can have first, second, third, fourth, fifth plate cover channels 130, each reducing $ID_1$ and $OD_1$ to $ID_{1a}$ and $OD_{1a}$, respectively, at the channel 130. The second plate cover 102 can have an inner diameter ID of $ID_2$ and an outer diameter of $OD_2$. The second plate cover 102 can have first, second, third, fourth, and fifth plate cover channels 130, each reducing $ID_2$ and $OD_2$ to $ID_{2a}$ and $OD_{2a}$, respectively, at the channel 130. The third plate cover 102 can have an inner diameter ID of $ID_3$ and an outer diameter of $OD_3$. The third plate cover 102 can have first, second, third, fourth, and fifth plate cover channels 130, each reducing $ID_3$ and $OD_3$ to $ID_{3a}$ and $OD_{3a}$, respectively, at the channel 130.

$OD_1$ can be less than $ID_2$, $OD_{1a}$ can be less than $ID_{2a}$, and $ID_{2a}$ can be less than $OD_1$ so as to allow the second plate cover 102 to slide over the first plate cover 102 in a nested manner when the first plate cover channels 130 are aligned with the second plate cover channels 130. When the first plate cover channels 130 are aligned with the second plate cover channels 130, the butts 134 of the second plate cove channels 130 are received in the mouths 132 of the first plate cover channels 130 due to $OD_{1a}$ being less than $ID_{2a}$. When the first plate cover channels 130 are not aligned with the second plate cover channels 130, the butts 134 of the second plate cover channels 130 rest against the first plate cover top 112 due to $ID_{2a}$ being less than $OD_1$.

$OD_2$ can be less than $ID_3$, $OD_{2a}$ can be less than $ID_{3a}$, and $ID_{3a}$ less than $OD_2$ so as to allow the third plate cover 102 to slide over the second plate cover 102 (which may be nested over the first plate cover 102) in a nested manner when the second plate cover channels 130 are aligned with the third plate cover channels 130. When the second plate cover channels 130 are aligned with the third plate cover channels 130, the butts 134 of the third plate cover channels 130 are received in the mouths 132 of the second plate cover channels 130 due to $OD_{2a}$ being less than $ID_{3a}$. When the second plate cover channels 130 are not aligned with the third plate cover channels 130, the butts 134 of the third plate cove channels 130 rest against the second plate cover top 112 due to $ID_{3a}$ being less than $OD_2$.

The fourth, fifth, sixth, etc. plate covers 102 can be similarly configured.

The system 100 can be placed into a collapsed configuration 106 by aligning the first, second, and third second plate cover channels 130 so that the butts 134 of the third plate cover channels 130 are received in the mouths 132 of the second plate cover channels 130, and the butts 134 of the second plate cover channels 130 are received in the mouths 132 of the first plate cover channels 130. The third plate cover 102 can be forced upwards to remove the third plate channels 130 from the second plate channels 130. The third plate cover 102 can be completely removed from the second plate cover 102 if it is desired. This can facilitate placing an article 110 on top of the second plate cover top 112. If the third plate cover was removed, the third plate cover 102 can be placed back on top of the second plate cover 102. The third plate cover 102 can be rotated to cause the third plate channels 130 to misalign with the second plate channels 130. The butts of the third plate cover channels 130 can then rest upon the second plate cover top 112 to generate a protracted configuration 104 between the third plate cover 102 and the second plate cover 102. In the protracted configuration, the article 110 resides within the volume of space 108 between the third plate cover first side 120 and the second plate cover second side 122. As noted herein, the article 110 can be food so the volume of space 108 can be such that none of the first side 120 of the third plate cover 102 makes contact with the article 110. Thus, the height Ht of sidewalls 114 of the plate covers 102 can be set at a length to generate a volume of space 108 that accommodates an anticipated article 110. The same can be done for the second plate cover 102 and/or the third plate cover 102 with respect to the first plate cover 102.

Referring back to the protracted configuration between the third plate cover 102 and the second plate cover 102, the third plate cover 102 can be rotated again to cause the third plate channels 130 to align with the second plate channels 130, thus allowing the butts 134 of the third plate cover channels 130 to slide within the mouths of the second plate cover channels 130, thereby facilitating transitioning to the collapsed configuration 106 between the third plate cover 102 and the second plate cover 102. (See FIG. 5). As the collapsed configuration 106 would generate a volume of space 108 between the third plate cover first side 120 and the second plate cover second side 122 that is less than the volume of space 108 when in the protracted configuration 104, it is contemplated for the article 110 to be removed before transitioning the system 100 to the collapsed configuration 106. The same can be done for the second plate cover 102 and/or the third plate cover 102 with respect to the first plate cover 102.

It should be noted that any combination of plate covers 102 can be in a collapsed configuration 106 while any other combination of plate covers 102 can be in a protracted configuration 104. Thus, while placing all of the plate covers 102 in a collapsed configuration 106 can be done to stow the system 100, it is not necessary to place them all in a collapsed configuration 106. For example, the first plate cover 102 and the second plate cover 102 may be transitioned into a collapsed configuration 106, while the third plate cover 102 is in a protracted configuration 104. As another example, the first, second, third, fifth, and sixth plate covers 102 can be transitioned into a collapsed configuration 106, while a forth plate cover 102 is in a protracted configuration 104. As another example, all of the plate covers 102 may be transitioned into a protracted configuration 104. Any combination or permutation of collapsed and protracted configurations 104, 106 can be used.

In some embodiments, the second side 122 of the plate cover top 112 can have a pattern 136 (e.g., a star, square, diamond, etc.) to indicate to a user where the channels 130 are located or orientated. For example, a star pattern 136 can be formed on the second side 122 of the plate cover top 112 so that the points of the star point to where the channels 130 in the sidewalls 114 are located. This can assist a user in determining the orientation of the channels 130. In some embodiments, the pattern 136 can be a relief pattern so that the pattern 136 is also on the first side 120 of the plate cover top 112. This can allow the first side 120 of a pattern 136 of one plate cover 102 to engage the second side 122 of a pattern 136 of another plate cover 102.

Referring to FIGS. 7-18, it is contemplated for the system 100 to be used as a kit. The kit can include a first set of plate covers 102 having a first predetermined size and shape, a second set of plate covers 102 having a second predetermined size and shape, a third set of plate covers 102 having a third predetermined size and shape, etc. For example, the kit can have a first set of large sized plate covers 102 having a circular shape, a second set of small sized plate covers 102 having a circular shape, a third set of mid-sized plate covers 102 having an oval shape, etc.

Any portion of a plate cover 102 can have ridges, ribs, grooves, etc. formed therein. This can be done for aesthetic purposes and/or to provide added rigidity and structural strength to the plate cover 102.

In at least one embodiment, the system 100 can be used in the following manner. The system 100 can include a first plate cover 102, a second plate cover 102, a third plate cover 102, and a base 124. The system 100 can be placed into a collapsed configuration 106 by aligning the first, second, and third second plate cover channels 130 so that the butts 134 of the third plate cover channels 130 are received in the mouths 132 of the second plate cover channels 130, and the butts 134 of the second plate cover channels 130 are received in the mouths 132 of the first plate cover channels 130. The base-engaging portion 126 of the first plate cover 102 can be engaged with a rim 128 portion of the base 124.

The third plate cover 102 and second plate cover 102 can be forced upwards to remove the second plate channels 130 from the first plate channels 130. The third plate cover 102 and the second plate cover 102 can be completely removed from the first plate cover 102. This can facilitate placing a first article 110 on top of the first plate cover top 112. The third plate cover 102 and the second plate cover 102 can be placed back on top of the first plate cover 102. The third plate cover 102 and the second plate cover 102 can be rotated in unison to cause the third plate channels 130 and the second plate channels 130 to misalign with the first plate channels 130. The butts 134 of the second plate cover channels 130 can then rest upon the first plate cover top 112 to generate a protracted configuration 104 between the second plate cover 102 (which in this case includes the third plate cover 102) and the first plate cover 102. In the protracted configuration, the first article 110 resides within the volume of space 108 between the second plate cover first side 120 and the first plate cover second side 122.

The third plate cover 102 can be forced upwards to remove the third plate channels 130 from the second plate channels 130. The third plate cover 102 can be completely removed from the second plate cover 102. This can facilitate placing a second article 110 on top of the second plate cover top 112. The third plate cover 102 can be placed back on top of the second plate cover 102. The third plate cover 102 can be rotated to cause the third plate channels 130 to misalign with the second plate channels 130. The butts 134 of the third plate cover channels 130 can then rest upon the second plate cover top 112 to generate a protracted configuration 104 between the third plate cover 102 and the second plate cover 102. In the protracted configuration, the second article 110 resides within the volume of space 108 between the third plate cover first side 120 and the second plate cover second side 122.

The third plate cover 102 can be lifted from the second plate cover 102 to remove the second article 110. The third plate cover 102 can be placed back on top of the second plate cover 102. The third plate cover 102 can be rotated to cause the third plate channels 130 to align with the second plate channels 130, thus allowing the butts 134 of the third plate cover channels 130 to slide within the mouths 132 of the second plate cover channels 130, thereby facilitating transitioning to a collapsed configuration 106 between the third plate cover 102 and the second plate cover 102.

The third plate cover 102 and the second plate cover 102 can be lifted from the first plate cover 102 to remove the first article 110. The third plate cover 102 and the second plate cover 102 can be placed back on top of the first plate cover 102. The third plate cover 102 and the second plate cover 102 can be rotated to cause the second plate channels 130 to align with the first plate channels 130, thus allowing the butts 134 of the second plate cover channels 130 to slide within the mouths 132 of the first plate cover channels 130, thereby facilitating transitioning to a collapsed configuration 106 between the second plate cover 102 and the first plate cover 102.

FIGS. 19-30 shows various views of exemplary large, small, oval, and stainless steel plate cover systems of FIGS. 7-18.

Figure 31:
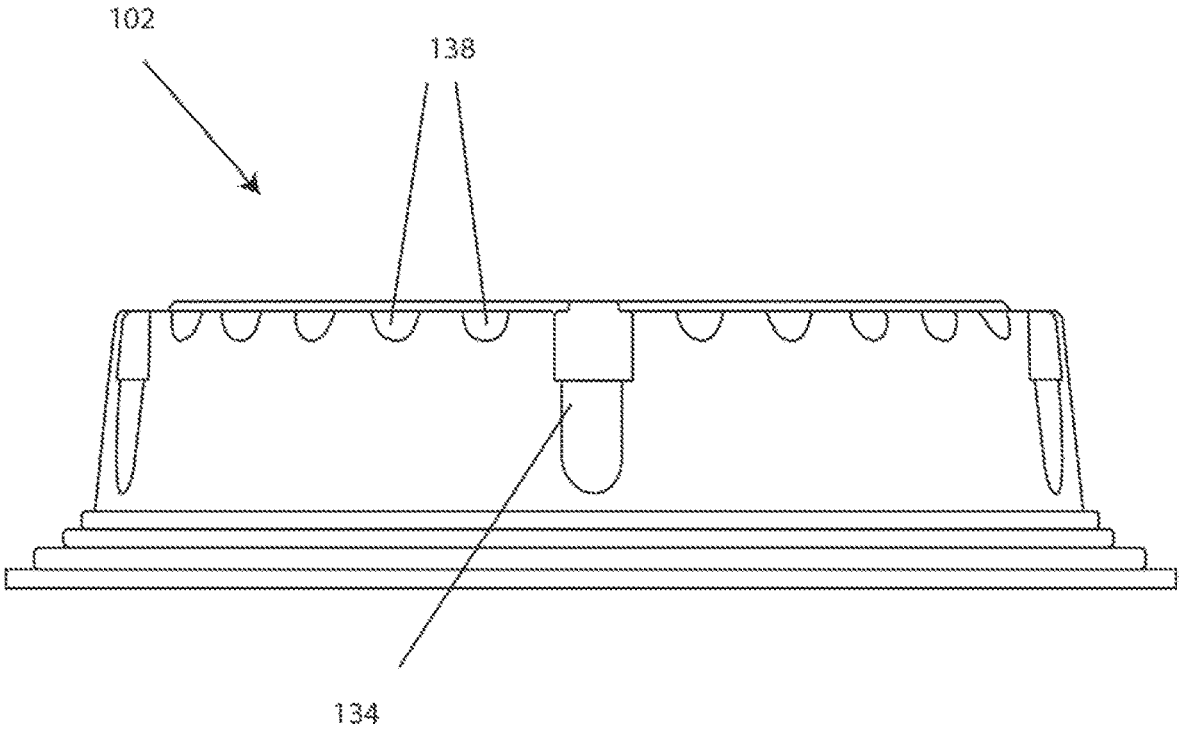
FIGS. 31-36 show embodiments of a plate cover having rotation retention mechanisms.
Figure 32:
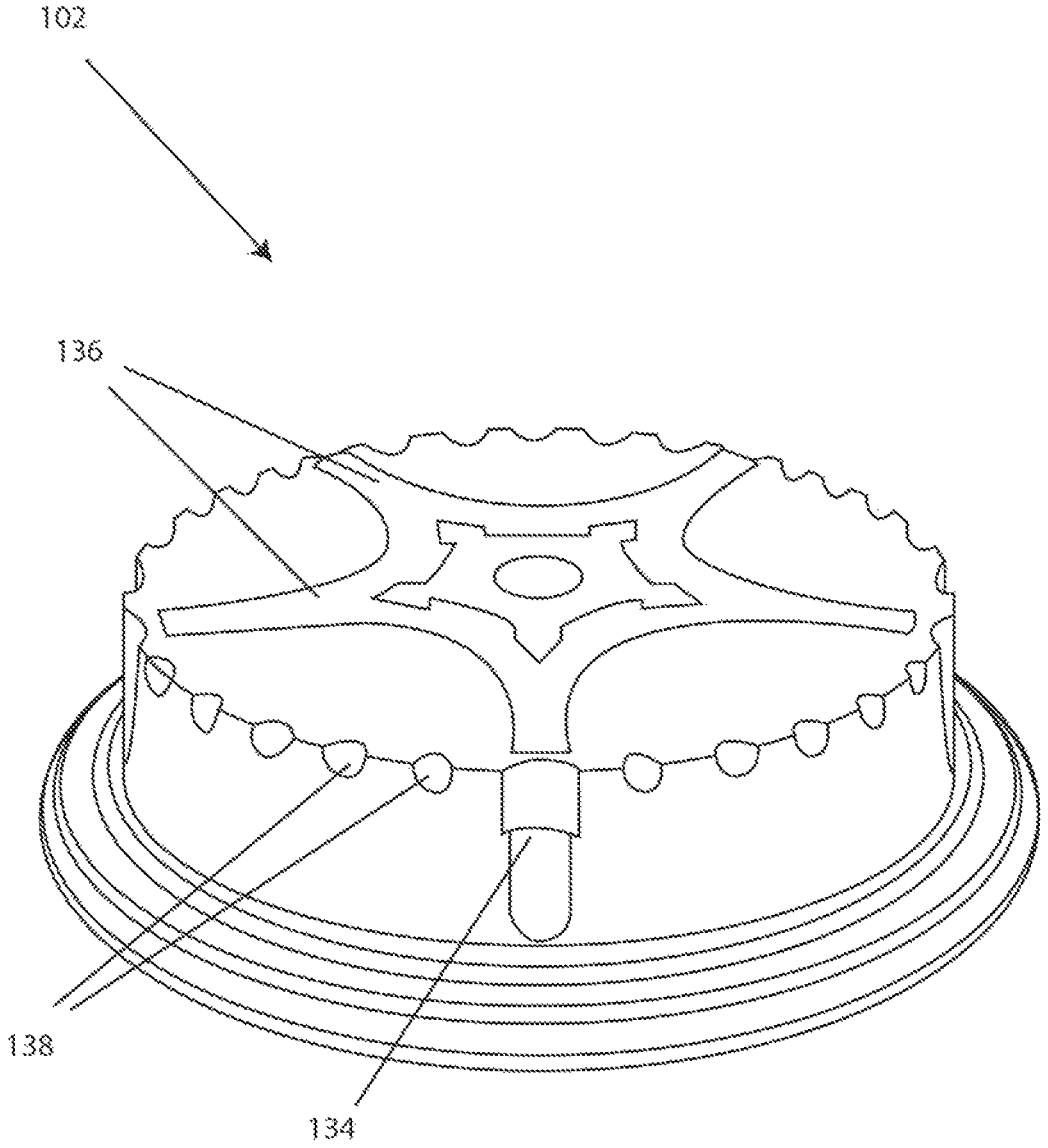
Figure 33:
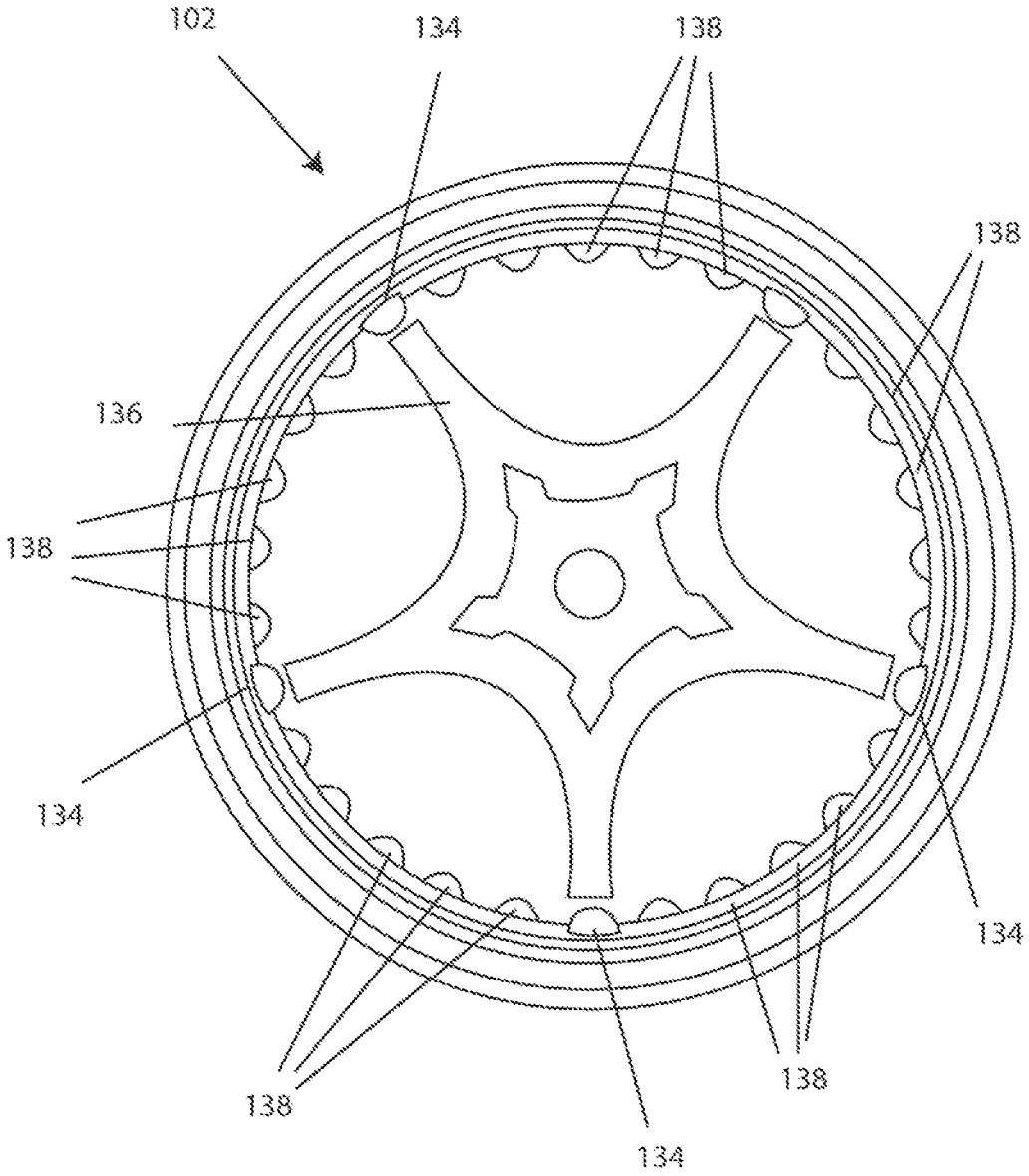
Figure 34:
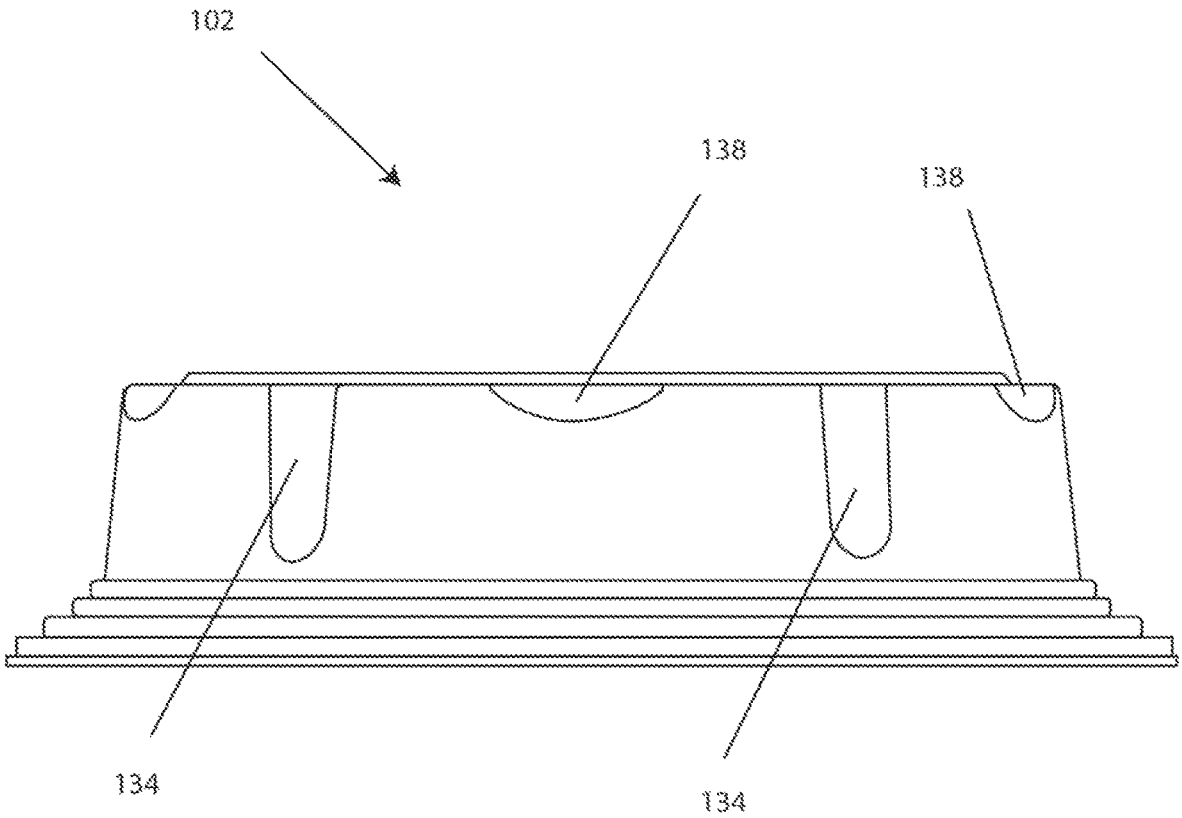
Figure 35:
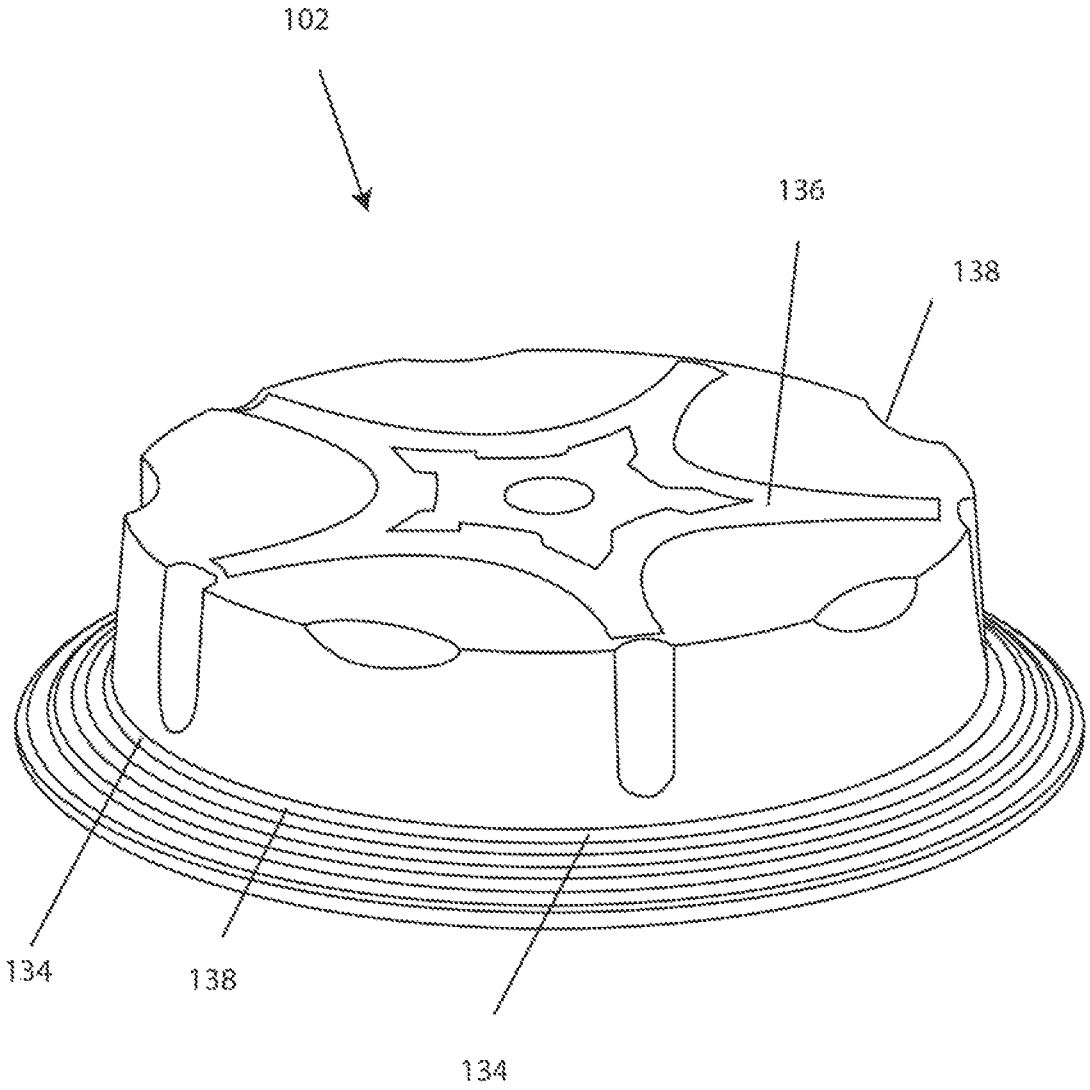
Figure 36:
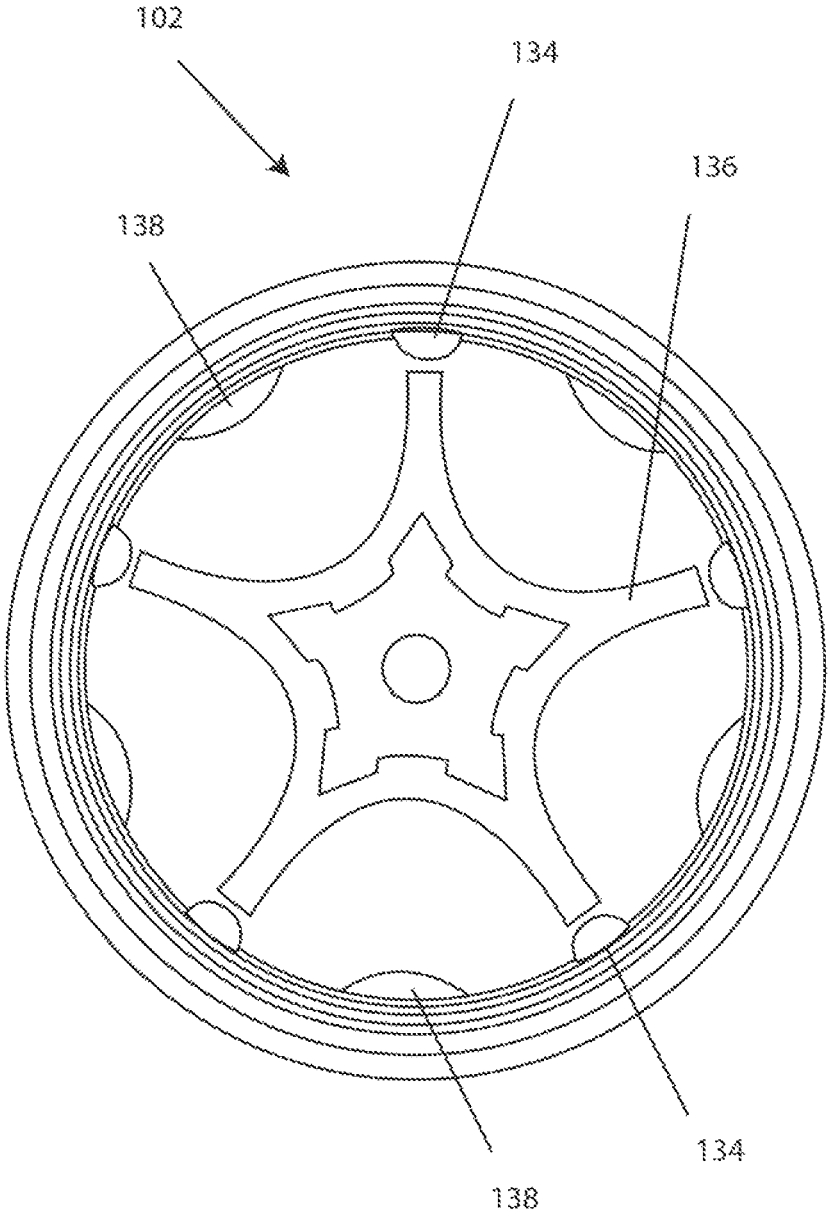

Referring to FIGS. 31-36, some embodiments include a rotation retention mechanism 138 for securing the plate covers in place when in a protected configuration. FIGS. 31-33 show an embodiment of a circular plate cover 102 having twenty-five rotation retention mechanisms 138, and FIGS. 34-36 show a circular plate cover 102 having five rotation retention mechanisms 138. It should be noted that any number of rotation retention mechanisms 138 can be used and for any shaped (e.g., circular, oval, etc.) plate cover 102, for any sized plate cover (e.g., small medium, large, etc.), and regardless of the plate cover 102 being transparent, opaque, etc.

The retention mechanism 138 can be a detent or equivalent structure formed in the surface of the plat cover second side 122. While the plate cover system 100 is in a protected configuration 104 (e.g., a first plate cover 102 is extended up from a second plate cover 102), the first plate cover 102 can be rotated until its butt 134 portions of its channels 130 engage with the rotation retention mechanism 138 (e.g., slide into the detent) of the second plate cover 102. Once the butt 134 portions of the first plate cover 102 are engaged with the detent 138, the first plate cover 102 and the second plate cover 102 are then locked in place so as to prevent relative rotation between the two. If relative rotation between the two is subsequently desired, the first plate cover 102 can be slightly raised to disengage the butts 134 from the detents 138 to allow the first plate cover 102 to be freely rotated relative to the second plate cover 102. The number of detents 138 can be selected to provide a desired level of rotational control (e.g., more detents can facilitate more locking positions). In addition, the widths and depths of the detents 138 can be selected to provide more or less play in the locking state.

In some embodiments, the pattern 136 can be a textured surface, include a non-slip covering (e.g., silicon, rubber, etc.), etc. This can provide additional means to prevent rotation of the plate covers 102, but while in the collapsed configuration 106. Having a covering such as silicon or rubber can also provide protection to the surfaces of the plate covers 102 so as to prevent scratching or other markings when the surface of the plate covers 102 abut each other in the collapsed configuration 106.

It should be understood that modifications to the embodiments disclosed herein can be made to meet a particular set of design criteria. For instance, the number of or configuration of plate covers 102, channels 130, bases 124, kits, and/or other components or parameters may be used to meet a particular objective.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

Therefore, it is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of apparatuses and methods of making and using the same have been discussed and illustrated herein, it is to be distinctly understood that the invention is not limited thereto but may be otherwise variously embodied and practiced within the scope of the following claims.

What is claimed is:

1. A plate cover, comprising:

a member having a closed top conjoined with sidewalls and an open bottom, forming a cavity, wherein the member has a first side and a second side, the first side being a portion of the member adjacent the cavity and the second side being a portion of the member subtending the cavity, wherein the member has an inner diameter and an outer diameter;

at least one channel formed in the sidewalls, the at least one channel extending in a direction from the member top to the member bottom, the at least one channel having a mouth that is open and a butt that is closed;

at least one retention mechanism formed in a surface of the second side;

wherein:

the at least one channel reduces the inner diameter and the outer diameter of the member at the at least one channel;

the at least one channel is configured to receive or be received by at least one channel of another member;

the butt of the at least one channel has a shape that complements a shape of the at least one retention mechanism facilitating engagement with the at least one retention mechanism;

the at least one retention mechanism is located axially above the butt of the at least one channel, and the butt of the at least one channel is located axially above the member bottom.

2. The plate cover recited in claim 1, wherein the at least one channel comprises a plurality of channels.

3. The plate cover recited in claim 2, wherein each channel of the plurality of channels is spaced equidistant from each other.

4. The plate cover recited in claim 1, wherein the member has a base-engaging portion at or near the member bottom.

5. The plate cover recited in claim 1, wherein the member has a pattern formed in or on the first side and/or second side at the member top.

6. The plate cover recited in claim 1, wherein the member comprises plastic.

7. The plate cover recited in claim 1, wherein the member is transparent.

8. A plate cover system, comprising:

a first plate cover, comprising:

a member with a closed first plate cover top conjoined with first plate cover sidewalls and an open first plate cover bottom to form a first plate cover cavity, the first plate cover having a first plate cover first side and a first plate cover second side, the first plate cover first side being a portion of the first plate cover adjacent the first plate cover cavity and the first plate cover second side being a portion of the first plate cover subtending the first plate cover cavity, wherein the first plate cover has an inner diameter ID1 and an outer diameter OD1;

a first plate cover channel formed in the first plate cover sidewalls, the first plate cover channel extending in a direction from the first plate cover top to the first plate cover bottom, the first plate cover channel having a first plate cover mouth that is open and a first plate cover butt that is closed, wherein the first plate cover channel reduces the ID1 and the OD1 to ID1*a* and OD1*a*, respectively, at the first plate cover channel;

a first plate cover retention mechanism formed in a surface of the first plate cover second side;

a second plate cover, comprising:

a member with a closed second plate cover top conjoined with second plate cover sidewalls and an open second plate cover bottom to form a second plate cover cavity, the second plate cover having a second plate cover first side and a second plate cover second side, the second plate cover first side being a portion of the second plate cover adjacent the second plate cover cavity and the second plate cover second side being a portion of the second plate cover subtending the second plate cover cavity, wherein the second plate cover has an inner diameter ID2 and an outer diameter OD2;

a second plate cover channel formed in the second plate cover sidewalls, the second plate cover channel extending in a direction from the second plate cover top to the second plate cover bottom, the second plate cover channel having a second plate cover mouth that is open and a second plate cover butt that is closed, wherein the second plate cover channel reduces the ID2 and the OD2 to ID2*a* and OD2*a*, respectively, at the second plate cover channel;

a second plate cover retention mechanism formed in a surface of the second plate cover second side;

wherein when the second plate cover is placed on top of the first plate cover:

the first plate cover channel is configured to receive the second plate cover channel when the second plate cover channel and the first plate cover channel are aligned to generate a collapsed configuration between the first plate cover and the second plate cover; and the second plate cover butt is configured to rest upon the first plate cover top when the second plate cover channel and the first plate cover channel are misaligned to generate a protracted configuration between the first plate cover and the second plate cover;

the second plate cover butt of the second plate cover channel is configured to engage the first plate cover retention mechanism when the plate cover system is in the protracted configuration;

wherein:

wherein at least one of the first and second plate cover butts has a shape that complements a shape of at least one of the first and second plate cover retention mechanisms;

at least one of the first and second plate cover retention mechanisms is located axially above the first and second plate cover, respectively;

a least one of the first and second plate cover butts is located axially above the first and second plate cover member bottoms, respectively.

9. The plate cover system recited in claim 8, wherein a volume of space is generated between the first plate cover second side and the second plate cover first side when in the protracted configuration that is larger than the volume of space generated between the first plate cover second side and the second plate cover first side when in the collapsed configuration.

10. The plate cover system recited in claim 9, wherein the volume of space in the protracted configuration is configured to display an article by the article being placed on the first plate cover second side.

11. The plate cover system recited in claim 8, wherein the second plate cover bottom is configured to allow rotation of the second plate cover relative to the first plate cover when the second plate cover channel and the first plate cover channel are misaligned and when the second plate channel is misaligned with the first plate cover retention mechanism.

12. The plate cover system recited in claim 8, wherein the first plate cover bottom has a base-engaging portion.

13. The plate cover system recited in claim 8, further comprising a base.

14. The plate cover system recited in claim 8, further comprising a base with a rim and first plate cover bottom has a base-engaging portion configured to engage a rim of the base.

15. The plate cover system recited in claim 8, wherein OD1 is less than ID2, OD1*a* is less than ID2*a*, and ID2*a* is less than OD1.

16. The plate cover system recited in claim 8, further comprising:

a third plate cover, comprising:

a member with a closed third plate cover top conjoined with third plate cover sidewalls and an open third plate cover bottom to form a third plate cover cavity, the third plate cover having a third plate cover first side and a third plate cover second side, the third plate cover first side being a portion of the third plate cover adjacent the third plate cover cavity and the third plate cover second side being a portion of the third plate cover subtending the third plate cover cavity, wherein the third plate cover has an inner diameter ID3 and an outer diameter OD3;

a third plate cover channel formed in the third plate cover sidewalls, the third plate cover channel extending in a direction from the third plate cover top to the third plate cover bottom, the third plate cover channel having a third plate cover mouth that is open and a third plate cover butt that is closed, wherein the third plate cover channel reduces the ID3 and the OD3 to ID3*a* and OD3*a*, respectively, at the third plate cover channel;

a third plate cover retention mechanism formed in a surface of the third plate cover second side.

17. The plate cover system recited in claim 16, wherein when the third plate cover is placed on top of the second plate cover:

the second plate cover channel is configured to receive the third plate cover channel when the third plate cover channel and the second plate cover channel are aligned to generate a collapsed configuration between the second plate cover and the third plate cover; and the third plate cover butt is configured to rest upon the second plate cover top when the third plate cover channel and the second plate cover channel are misaligned to generate a protracted configuration between the second plate cover and the third plate cover;

the third plate cover butt of the third plate cover channel is configured to engage the second plate cover retention mechanism when the plate cover system is in the protracted configuration.

18. The plate cover system recited in claim 16, wherein OD2 is less than ID3, OD2*a* is less than ID3*a*, and ID3*a* is less than OD2.

19. The plate cover system recited in claim 16, wherein the first plate cover bottom has a first plate cover base-engaging portion, the second plate cover bottom has a second plate cover base-engaging portion, and the third plate cover bottom has a third plate cover base-engaging portion.

20. The plate cover system recited in claim 16, wherein:

the second plate cover bottom is configured to allow rotation of the second plate cover relative to the first plate cover when the second plate cover channel and the first plate cover channel are misaligned and when the second plate channel is misaligned with the first plate cover retention mechanism; and the third plate cover bottom is configured to allow rotation of the third plate cover relative to the second plate cover when the third plate cover channel and the second plate cover channel are misaligned and when the third plate channel is misaligned with the second plate cover retention mechanism.

* * * * *